US011832666B2

(12) United States Patent
Yamauchi

(10) Patent No.: US 11,832,666 B2
(45) Date of Patent: Dec. 5, 2023

(54) VENTILATION APPARATUS

(71) Applicant: MAKITA CORPORATION, Anjo (JP)

(72) Inventor: Ken Yamauchi, Anjo (JP)

(73) Assignee: MAKITA CORPORATION, Anjo (JP)

( * ) Notice: Subject to any disclaimer, the term of this patent is extended or adjusted under 35 U.S.C. 154(b) by 61 days.

(21) Appl. No.: 17/567,378

(22) Filed: Jan. 3, 2022

(65) Prior Publication Data

US 2022/0218060 A1 Jul. 14, 2022

(30) Foreign Application Priority Data

Jan. 12, 2021 (JP) ..... 2021-002795

(51) Int. Cl.
*A41D 27/28* (2006.01)
*F04D 25/08* (2006.01)

(52) U.S. Cl.
CPC ..... *A41D 27/28* (2013.01); *F04D 25/084* (2013.01)

(58) Field of Classification Search
CPC .... A41D 13/0025; A41D 27/28; F04D 25/08; F04D 25/084
See application file for complete search history.

(56) References Cited

FOREIGN PATENT DOCUMENTS

JP 6200606 B1 9/2017
JP 2018115646 * 7/2018

* cited by examiner

*Primary Examiner* — Brian O Peters
(74) *Attorney, Agent, or Firm* — Oliff PLC

(57) ABSTRACT

A ventilation apparatus includes a motor, a fan, a housing, and a ring. A projection protrudes from one of an outer peripheral surface of a peripheral wall part of the housing and an inner peripheral surface of the ring, whereas an engagement wall and a guide wall are provided on the other of the outer peripheral surface of the peripheral wall part of the housing and the inner peripheral surface of the ring. The guide wall has a guide surface configured to guide the ring rearward relative to the housing and to guide the projection to an engagement position at which the projection is abuttable on an engagement surface of the engagement wall. In a direction in which the projection moves away from the guide surface in a front-rear direction, an open space extends from the guide surface to an area that corresponds to an end of the second surface.

18 Claims, 10 Drawing Sheets

VENTILATION APPARATUS

CROSS-REFERENCE TO RELATED APPLICATION

The present application claims priority to Japanese patent application No. 2021-002795 filed on Jan. 12, 2021, the contents of the which are hereby fully incorporated herein by reference.

TECHNICAL FIELD

The present disclosure relates to a ventilation apparatus that is removably attachable to (mountable on) a garment.

BACKGROUND

Some known ventilation apparatuses can be removably attached to (mounted on) a garment, which is worn by a worker in hot work environment, and deliver air and ventilate inside the garment. For example, Japanese Patent No. 6200606 discloses a fan for use with a garment that includes a body and a separate retainer ring that is mountable around the body. The body includes a fan and a housing that accommodates the fan. The housing and the retainer ring each has a corresponding flange part. Engagement between internal threads on the retainer ring and external threads on a peripheral wall part of the housing allows a fabric to be held between the flange part of the housing and the flange part of the retainer ring.

SUMMARY

In order to attach and remove the above-mentioned fan to and from the garment, the user needs to rotate the retainer ring relative to the housing by a considerable angle in one direction. Therefore, this known fan still has room for improvement in the procedure for attachment and removal.

It is one, non-limiting object of the present disclosure to improve operability of a ventilation apparatus that is removably attachable to a garment.

One aspect of the present disclosure herein provides a ventilation apparatus that is removably attachable to a garment is provided. The ventilation apparatus includes a motor, a fan, a housing, and a ring.

The fan is configured to be rotationally driven by the motor around a first axis that defines a front-rear direction of the ventilation apparatus. The housing accommodates the motor and the fan. The housing includes a peripheral wall part and a first clamping part. The peripheral wall part has a hollow cylindrical shape and is disposed around the fan. The first clamping part protrudes radially outward from a rear end portion of the peripheral wall part. The ring has a hollow cylindrical shape and is removably mounted around the peripheral wall part of the housing. The ring has a second clamping part that is disposed in front of the first clamping part of the housing and configured to clamp a fabric of the garment in conjunction with the first clamping part.

At least one projection is provided on a first surface, which is one of an outer peripheral surface of the peripheral wall part and an inner peripheral surface of the ring. The at least one projection protrudes from the first surface in a radial direction of the peripheral wall part. At least one engagement wall and at least one guide wall are provided on a second surface, which is the other one of the outer peripheral surface of the peripheral wall part and the inner peripheral surface of the ring. The at least one engagement wall and the at least one guide wall respectively protrude from the second surface in the radial direction. The at least one engagement wall is located adjacent to one end of the at least one guide wall in a circumferential direction. Note that "the at least one engagement wall is located adjacent to one end of the at least one guide wall in a circumferential direction" may include (i) a first case in which "one end of the at least one engagement wall is located at a substantially same position as one end of the at least one guide wall in a circumferential direction", (ii) a second case in which "one end of the at least one engagement wall and one end of the at least one guide wall are spaced apart from each other with a slight gap therebetween in a circumferential direction", and (iii) a third case in which "one end of the at least one engagement wall and one end of the at least one guide wall are located to have a slight overlap with each other in a circumferential direction". The at least one engagement wall has at least one engagement surface. The at least one engagement surface is configured to block (prevent) the ring and the housing from moving away from each other in the front-rear direction.

The at least one guide wall has a guide surface that is configured to guide the ring rearward relative to the housing and to guide the at least one projection to at least one engagement position at which the projection is abuttable on the at least one engagement surface. In a direction in which the projection moves away from the guide surface in the front-rear direction, an open space extends from the guide surface to an area that corresponds to an end of the second surface.

The ventilation apparatus of this aspect can be attached to (mounted on) the garment by having the fabric of the garment clamped in the front-rear direction between the first clamping part of the housing and the second clamping part of the ring mounted around the peripheral wall part of the housing. When the ring is attached to the housing, the at least one projection provided on one of the housing and the ring abuts on and engages the engagement surface of the engagement wall provided on the other one of the housing and the ring. This configuration can thus prevent the ring from disengaging from (coming off) the housing.

Furthermore, in the process of attaching the ring to the housing, the guide surface of the guide wall guides the ring rearward relative to the housing and also guides the at least one projection to the at least one engagement position. In the direction in which the projection moves away from the guide surface in the front-rear direction, the open space extends from the guide surface to the area that corresponds to the end of the second surface. Specifically, in an embodiment in which the at least one projection abuts on the guide surface from the front (that is, the at least one guide wall is provided on the outer peripheral surface of the peripheral wall part of the housing), the open space extends in front of the guide surface. On the other hand, in another embodiment in which the at least one projection abuts on the guide surface from the rear (that is, the at least one guide wall is provided on the inner peripheral surface of the ring), the open space extends behind (to the rear of) the guide surface. In other words, the second surface has no protrusion in front of or behind the guide surface that may block the at least one projection from moving in the front-rear direction.

The configuration according to this aspect can eliminate the need for a user to position the ring relative to the housing precisely at a specific position in the circumferential direction. Instead, the user only needs to move the ring rearward until the at least one projection abuts on the guide surface of the at least one guide wall, followed by rotating the ring in the circumferential direction so that the at least one projection slides on (along) the guide surface. This simple manipulation can swiftly place the at least one projection at the at least one engagement position where the projection abuts on the engagement surface. According to this aspect, the ventilation apparatus can thus have an improved operability in attaching the ring to the housing.

DESCRIPTION OF EMBODIMENTS

Figure 1:
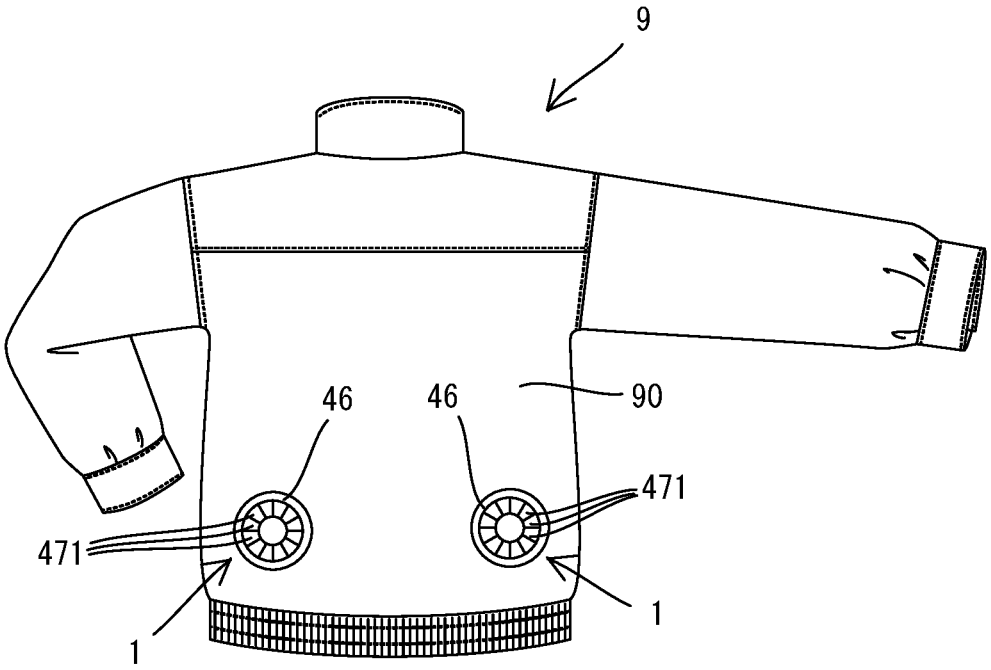
FIG. 1 is a rear view of a jacket.

In one or more embodiments of the present disclosure, at least one first rotation-restriction part may be provided on one of the housing and the ring. At least one second rotation-restriction part may be provided on the other one of the housing and the ring. The at least second rotation-restriction part may be configured to engage with the first rotation-restriction part to restrict rotation of the ring relative to the housing around the first axis.

According to the this embodiment, engagement between the first rotation-restriction part and the second rotation-restriction part restricts rotation of the ring relative to the housing. This reduces the possibility that the at least one projection moves in the circumferential direction from the at least one engagement position and away from the engagement wall, which may cause the ring to come off the housing. Note that the term "restrict" used herein not only refers to completely preventing (prohibiting) rotation but also to allowing some rotation under a certain condition (when subjected to an external force, for example); therefore, the term can also be rephrased as "selectively (conditionally) prevent".

In one or more embodiments of the present disclosure, the at least one first rotation-restriction part may include the at least one projection provided on the first surface. The at least one second rotation-restriction part may include at least one restriction wall protruding from the second surface. The at least one restriction wall may be located on a side of the at least one engagement position toward the at least one guide wall in the circumferential direction.

In the ventilation apparatus of this aspect, the at least one projection can fulfill two functions of: (i) preventing the ring from moving away from the housing in the front-rear direction; and (ii) restricting the ring from rotating in a direction that causes the at least one projection to disengage from the engagement wall in the circumferential direction. This simple structure can thus reduce more effectively the possibility of the ring coming off the housing.

In one or more embodiments of the present disclosure, in a case where the at least one guide wall is provided on the outer peripheral surface of the peripheral wall part, the guide surface may be a front surface of the at least one guide wall and may at least partially be inclined rearward as it extends toward the above-mentioned one end in the circumferential direction. In a case where the at least one guide wall is provided on the inner peripheral surface of the ring, the guide surface may be a rear surface of the at least one guide wall and may at least partially be inclined frontward as it extends toward the above-mentioned one end in the circumferential direction. According to this aspect, the user can attach the ring to the housing through ergonomically natural operations of rotating the ring circumferentially relative to the housing while moving the ring rearward.

In one or more embodiments of the present disclosure, the at least one engagement surface may include a plurality of engagement surfaces that are located differently from each other in both the front-rear direction and the circumferential direction. According to this aspect, the user can select one of the engagement positions for the projection according to the thickness of the fabric of the garment to which the ventilation apparatus is attached, so that the fabric can be clamped appropriately between the first clamping part and the second clamping part. Furthermore, according to this aspect, the plurality of engagement surfaces are formed on the same engagement wall. This allows the user to stop the ring such that the projection engages one suitable engagement surface, among the plurality of engagement surfaces, according to the thickness of the fabric while rotating the ring circumferentially relative to the housing. This configuration can eliminate the need for the user to remove the ring from the housing and then attach it again, and thus allows for a simplified procedure.

In one or more embodiments of the present disclosure, the at least one projection may include a plurality of projections that are disposed at equal intervals in the circumferential direction. The at least one guide wall may include a plurality of guide walls that are disposed at equal intervals in the circumferential direction. The at least one engagement wall may include a plurality of engagement walls that are disposed at equal intervals in the circumferential direction. Each of the plurality of guide walls may extend in the circumferential direction between two neighboring engagement walls among the plurality of engagement walls. According to this aspect, the plurality of projections can respectively engage with the plurality of engagement walls. This configuration can reduce more reliably the possibility of the ring coming off the housing. Furthermore, the guide surfaces of the plurality of guide walls, which respectively correspond to the plurality of the engagement walls, can guide the plurality of projections respectively to their suitable engagement positions.

In one or more embodiments of the present disclosure, the at least one projection may protrude from the inner peripheral surface of the ring. The at least one guide wall and the at least one engagement wall may each protrude from the outer peripheral surface of the peripheral wall part of the housing. The housing has a length of a certain level in the front-rear direction such that the motor and the fan can be accommodated in the housing. According to this aspect, the at least one guide wall and the at least one engagement wall are provided on the housing, and thus the ring, on which the projection is provided, is allowed to have a minimum length in the front-rear direction.

In one or more embodiments of the present disclosure, the housing may be formed by a first member and a second member that are separably connected to each other in the front-end direction. The first member may at least include the first clamping part and an inlet-side cover. The inlet-side cover may have a plurality of inlet openings and cover an opening at a rear end of the peripheral wall part. The second member may at least include a portion of the peripheral wall part and a discharge-side cover. The discharge-side cover may have a plurality of discharge openings and cover an opening at a front end of the peripheral wall part. The first member may include the at least one engagement wall. Prolonged use of the ventilation apparatus may cause dustiness inside the housing and on the fan. According to this aspect, the user can separate the first member and the second member to clean the fan and inside the housing. Furthermore, since the at least one engagement wall is provided on the first member, the ring cannot be attached to the housing unless the first member is connected to the second member. This configuration can prevent the ventilation apparatus from being attached to and used with the garment when the housing is incomplete.

In one or more embodiments of the present disclosure, the motor and the fan may be accommodated in the second member. Therefore, according to this aspect, the ventilation apparatus can be prevented from being used without the inlet-side cover (that is, the cover for the fan) in place.

In one or more embodiments of the present disclosure, the second member may include the at least one guide wall. On the inner peripheral surface of the ring, at least one additional projection may be provided more frontward than the at least one projection and may protrude radially inward from the inner peripheral surface. According to this aspect, in the event that the first member and the second member are disconnected while the at least one projection of the ring is engaged with the at least one engagement wall of the first member, the at least one additional projection of the ring can abut on the at least one guide wall to thereby prevent the second member from coming off through the ring.

In one or more embodiments of the present disclosure, the first member may include a first peripheral wall part that is a portion of the peripheral wall part. The second member may include a second peripheral wall part that is another portion of the peripheral wall part and that is partially fitted around the first peripheral wall part. An outer peripheral surface of the second peripheral wall part may form the above-mentioned outer peripheral surface of the peripheral wall part. The at least one engagement wall may be provided on the first peripheral wall part of the first member, and may protrude radially outward from the outer peripheral surface through at least one recess formed in the second peripheral wall part. This allows the at least one engagement wall to be provided on the first member in a reasonable configuration.

In one or more embodiments of the present disclosure, the second member may include at least one engagement piece. The at least one engagement piece may each have a hook on its tip end portion and may be elastically deformable in the radial direction. The hook may be engaged with the at least one engagement wall such that the hook is disengageable in response to elastic deformation of the at least one engagement piece. This achieves a reasonable structure for separably connecting the first and the second members utilizing the at least one engagement wall.

In one or more embodiments of the present disclosure, the at least one projection may include a plurality of projections that are disposed at equal intervals in the circumferential direction. The at least one guide wall may include a plurality of guide walls that are disposed at equal intervals in the circumferential direction. The at least one engagement wall may include a plurality of engagement walls that are disposed at equal intervals in the circumferential direction. Each of the plurality of guide walls may extend in the circumferential direction between two neighboring engagement walls among the plurality of engagement walls. Each of the plurality of guide walls may have a first end and a second end in the circumferential direction. The guide surface may be a front surface of each of the plurality of guide walls, and may be configured to guide the projection in a first direction, which is a direction from the first end toward the second end. Each of the plurality of guide walls may be disposed such that the guide surface extends in the first direction substantially continuously from a front surface of one of the plurality of engagement walls that is located on a second direction side of the guide wall. The second direction is opposite to the first direction (i.e., a direction from the second end toward the first end). According to this aspect, the front surface of one guide wall and the front surface of one engagement wall that is located on the second direction side of the guide wall can, as a whole, function as a continuous guide surface for a next engagement wall that is located on a first direction side (i.e., on the opposite side) of the guide wall. Furthermore, engagements between the plurality of projections and the plurality of engagement walls at respective multiple positions in the circumferential direction can reduce more reliably the possibility of the ring coming off the housing.

In one or more embodiments of the present disclosure, the at least one guide wall has an approximately right triangular shape when the peripheral wall part is viewed from a position radially outward of the peripheral wall part. The first end may substantially connect to an end of the one engagement wall, among the plurality of engagement walls, that is located on the second direction side of the guide wall. A rear end of the at least one guide wall may substantially connect to a front surface of the first clamping part. The guide surface may be inclined rearward at a substantially constant angle as it extends from the first end to the second end. According to this aspect, the user can attach the ring to the housing through ergonomically natural operations of rotating the ring relative to the housing in the first direction while moving the ring rearward.

A fan unit 1 is described below as a representative, non-limiting example of a ventilation apparatus according to the present disclosure, with reference to the drawings. Also, a jacket 9 is described below as a representative, non-limiting example of a garment, to (on) which the ventilation apparatus can be removably attachable (mountable).

Firstly, an aspect of use of the fan unit 1 of this embodiment is briefly described.

Figure 2:
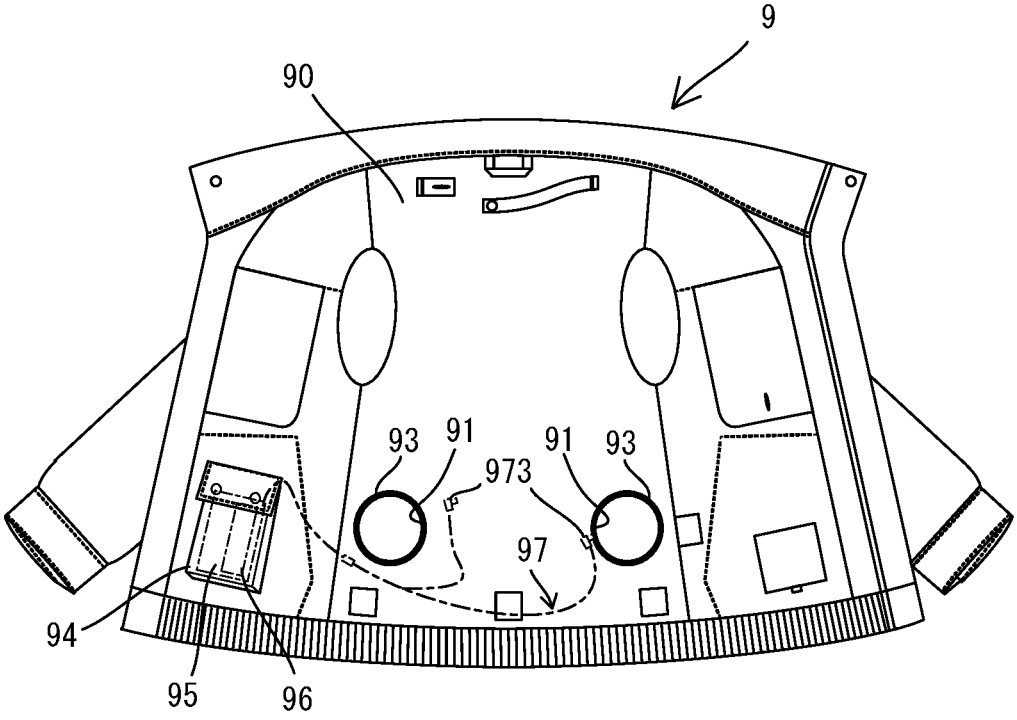
FIG. 2 is an illustration that shows a fan attachment portion of the jacket, a battery holder, and a connecting cable.

As shown in FIG. 1 and FIG. 2, the fan unit 1 of this embodiment is used in a state of being attached to (mounted on), for example, a jacket 9. The jacket 9 is a long-sleeved, open-front upper-body garment that is mainly made of a fabric 90 covering the upper half of a wearer. The fabric 90 has two attachment holes (mounting holes) 91 for attachment (mounting) of the fan unit 1. The attachment holes 91 are arranged at two positions in the lower section of a back-body portion of the fabric 90. Thus, two fan units 1 can be attached to the jacket 9. Each attachment hole 91 is an opening into which a housing 4 (specifically, a tubular part 41) of the fan unit 1 (see FIG. 3) can be inserted. Note that in the following description, the peripheral portion of each attachment hole 91 is also referred to as a fan attachment portion 93. An inner surface of the jacket 9 (of a front-body portion, for example) has a pocket 94 that can house a battery holder 95. The battery holder 95 has a rechargeable battery 96 mounted therein. A branched-end connecting cable 97 electrically connects the battery holder 95 and the two fan units 1.

When attached, the fan unit 1 is partially inserted inside the jacket 9 (to the side that faces the wearer's body) through the attachment hole 91, while inlet openings 471 are left exposed outside the jacket 9. The fan unit 1 sucks air outside the jacket 9 through the inlet openings 471 and discharges the air inside the jacket 9 through discharge openings 481 placed inside the jacket 9 (see FIG. 3). The air discharged inside the jacket 9 cools down the wearer's body as it circulates inside the jacket 9, and then flows out of the jacket 9 through cuffs and a collar. As such, the fan unit 1 attached to the jacket 9 can ventilate inside the jacket 9 and provide the user a comfortable environment for working.

Next, the general structure of the fan unit 1 is described.

As shown in FIGS. 3 to 6, the fan unit 1 includes a body 3 and a ring 5. The body 3 is mainly formed by a motor 33, a fan 36 that is rotationally driven by the motor 33, and the housing 4 that accommodates the motor 33 and the fan 36. The housing 4 is configured as a casing of an approximately circular shape as viewed in an extension direction of a rotational axis A1 of the fan 36 (hereinafter also simply referred to as a rotational-axis-A1 direction). At an end of the housing 4 in the rotational-axis-A1 direction, a flange 46 protrudes radially outward. The ring 5, as a whole, forms a short, hollow cylindrical body with a central axis A2. The ring 5 is removably attachable to (mountable around) the outer peripheral portion of the housing 4. At an end of the ring 5 in an extension direction of the central axis A2 (hereinafter also simply referred to as a central-axis-A2 direction), a flange 55 protrudes radially outward.

In this embodiment, the flange 46 of the body 3 is disposed outside the jacket 9 while the remaining parts of the body 3 other than the flange 46 are inserted inside the jacket 9 (that is, the side that faces the wearer's back) through the attachment hole 91. Then, from inside the jacket 9, the ring 5 is coaxially fitted (mounted) around the outer peripheral portion of the body 3 (the housing 4). This allows the flange 46 of the housing 4 and the flange 55 of the ring 5 to clamp the fabric 90 around the fan attachment hole 91 (at the fan attachment portion 93), and thereby results in the attachment of the fan unit 1 to the jacket 9.

Note that in the following description, for the sake of convenience, directions related to the fan unit 1 are defined based on the direction that the user faces when the user has put on the jacket 9 with the fan unit 1 attached thereto. Specifically, the direction along the rotational axis A1 of the fan 36 and of the central axis A2 of the ring 5 is defined as a front-rear direction. In the front-rear direction, a side on which the inlet openings 471 are located is defined as a rear side and the other side on which the discharge openings 481 are located is defined as a front side. According to the definitions of the directions, the flange 46 of the housing 4 may sometimes be referred to as the rear flange 46, whereas the flange 55 of the ring 5 may sometimes be referred to as the front flange 55. As for directions circumferentially around the rotational axis A1 and the central axis A2, the clockwise direction when the fan unit 1 is viewed from the front is defined as a first direction D1, and the counterclockwise direction is defined as a second direction D2.

The structures of the body 3 and the ring 5 of the fan unit 1 are described below in detail in this order.

Firstly, the ring 5 is described. As shown in FIGS. 3,4,6, and 7, the ring 5 includes a tubular part 51, the above-described front flange 55, and tabs 58. Note that in this embodiment, the tubular part 51, the front flange 55, and the tabs 58 are integrally formed of synthetic resin (polymeric material). The ring 5 is at least partially elastically deformable (deflectable, flexible) by a slight amount, at least in its radial direction.

The tubular part 51 is a short, hollow cylindrical body. The tubular part 51 is configured to be fitted (mounted) around the tubular part 41 of the housing 4. Three projections 52 are formed on the inner periphery of a rear end portion of the tubular part 51. Each projection 52 protrudes radially inward of the tubular part 51 from an inner peripheral surface 510 thereof. Each projection 52 is configured to be engaged with and held by an engagement wall 42 and a rotation-restriction part 43 of the tubular part 41 of the body 3, as will be described later. In this embodiment, each projection 52 has a generally rectangular (parallelepiped) shape, and has a front surface 520 that is approximately orthogonal to the central axis A2 of the ring 5. Furthermore, the three projections 52 are disposed at approximately equal intervals in a circumferential direction of the ring 5. In this embodiment, a length of protrusion of each projection 52 is set such that when the ring 5 is attached to the housing 4, a tip end (protruded end) of the projection 52 has no substantial contact with an outer peripheral surface 410 of the tubular part 41 of the housing 4. However, in a case where the rotation-restriction parts 43 (described below) are not provided, the projections 42 may be allowed to contact the outer peripheral surface 410 of the tubular part 41.

Figure 10:
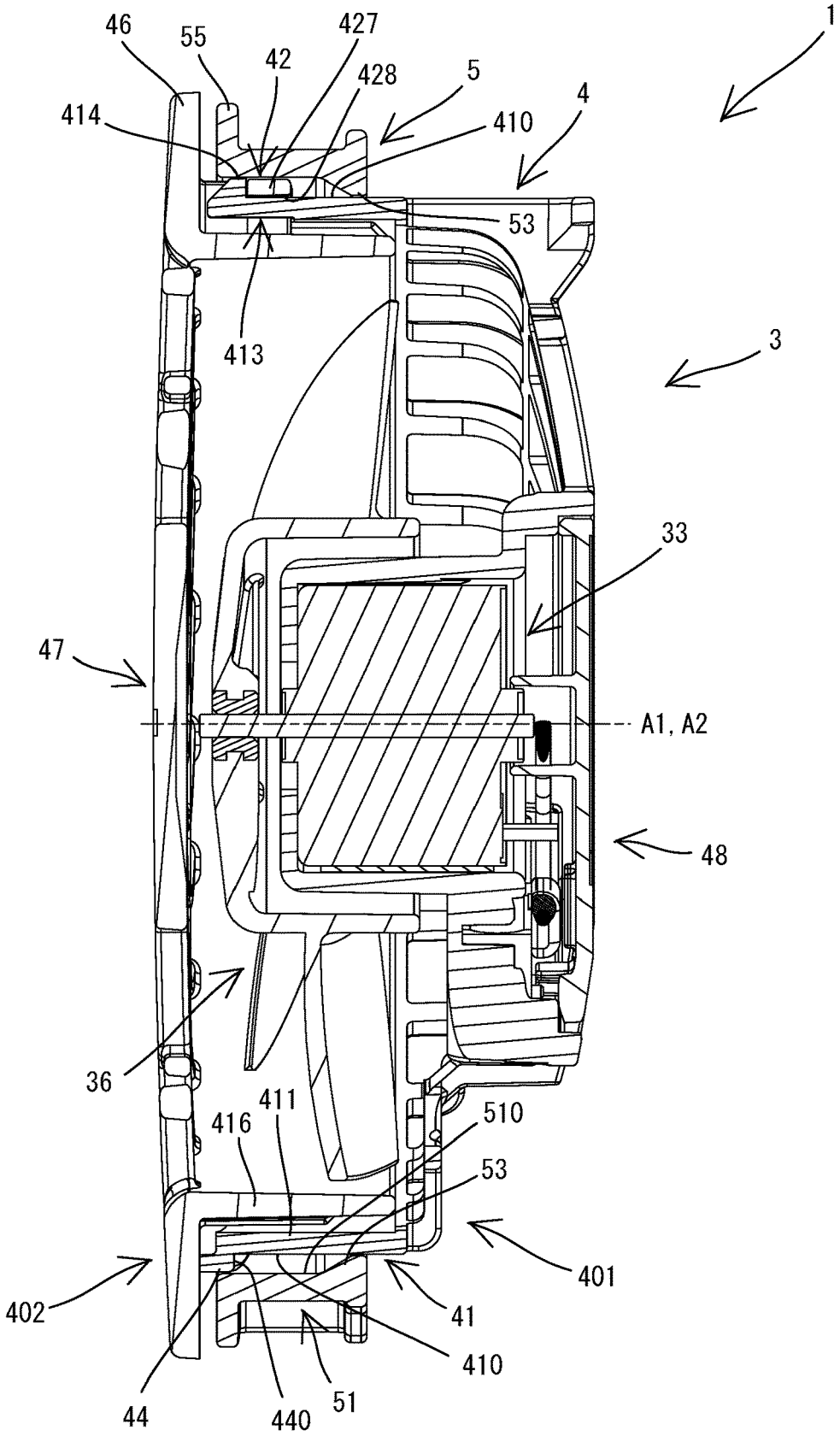
FIG. 10 is a cross-sectional view taken along line X-X of FIG. 5.

Three ridges 53 are formed on the inner periphery of a front end portion of the tubular part 51. Each ridge 53 extends in the circumferential direction, corresponding to a region between two neighboring projections 52. In other words, the ridges 53 are formed at positions different from those of the projections 52 (formed in regions with no projections 52). Note that a length of protrusion of each ridge 53 is set such that when the ring 5 is attached to the housing 4, a tip end (protruded end) of the ridge 53 substantially contacts the outer peripheral surface 410 of the tubular part 41 of the housing 4 (see FIG. 10).

The front flange 55 is a portion that functions to clamp the fan attachment portion 93 of the jacket 9 in conjunction with the rear flange 46 of the body 3. The front flange 55 protrudes radially outward from an end portion of the tubular part 51 in the central-axis-A2 direction (specifically, from the rear end portion). In this embodiment, the front flange 55 is formed into a circular ring. The front flange 55 has a rear surface 550 that extends in a direction approximately orthogonal to the central axis A2. Note that in this embodiment, the rear surface 550 of the front flange 55 is located at an approximately same position as rear ends of the projections 52 in the front-rear direction.

Each of the tabs 58 is a protruding piece of an approximately trapezoidal shape when viewed from the front. The tab 58 protrudes radially outward from an end portion of the tubular part 51 that is opposite to the end portion where the front flange 55 is provided (that is, from the front end portion). In this embodiment, six tabs 58 are provided on the tubular part 51 at approximately equal intervals in the circumferential direction. The user can have his/her fingers on the tabs 58 when rotating the ring 5 relative to the housing 4. This allows for easy rotation of the ring 5 relative to the body 3. Note that three of the tabs 58 are respectively arranged at the same positions as the three projections 52, circumferentially around the ring 5. A front surface of each of these three tabs 58 has an indication that shows where the corresponding projection 52 is.

The body 3 is described below. As described above, the body 3 is mainly formed by the motor 33, the fan 36, and the housing 4.

Figure 6:
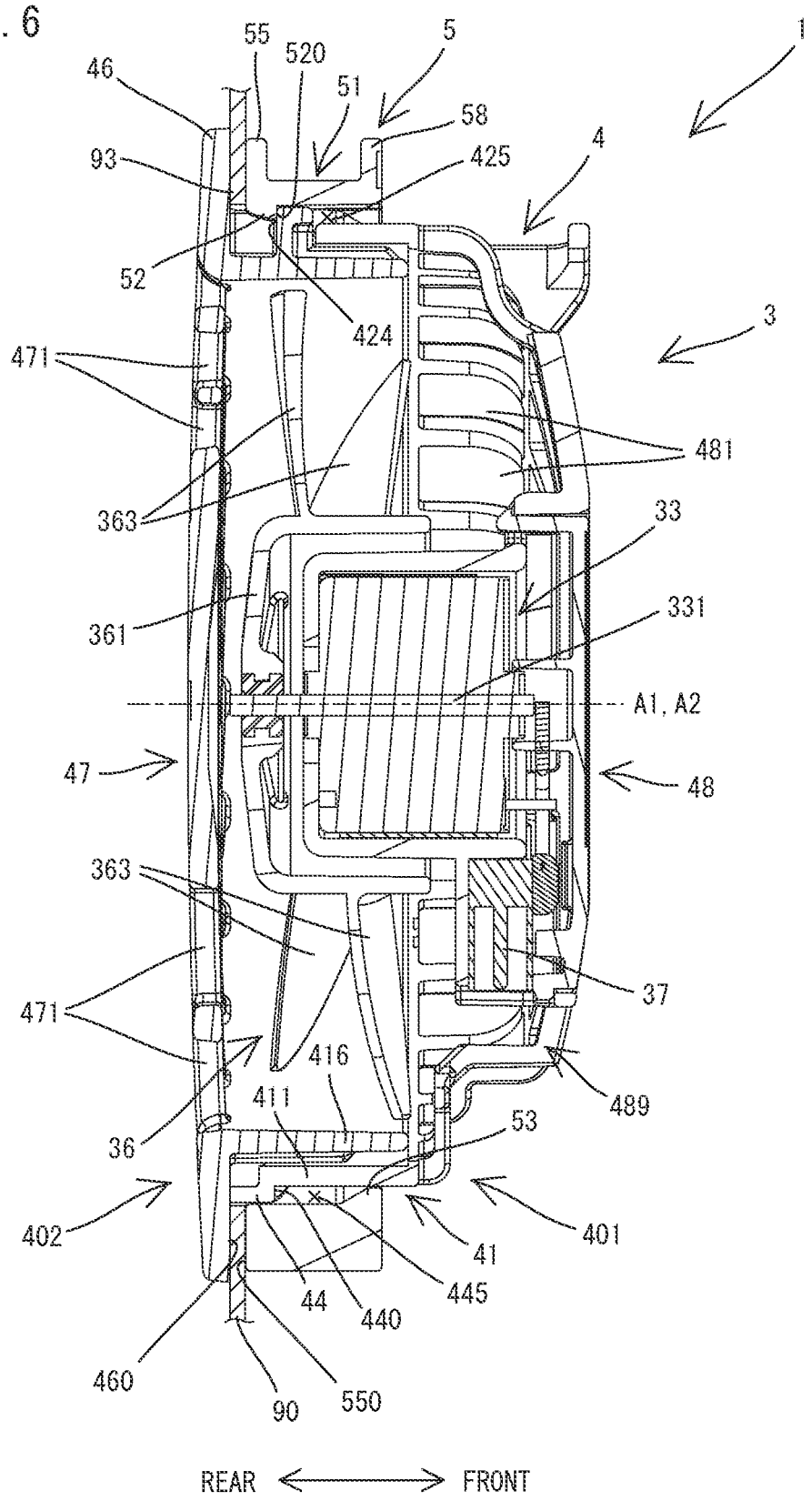
FIG. 6 is a cross-sectional view taken along line VI-VI of FIG. 5.

As shown in FIG. 6, the motor 33 and the fan 36 are disposed coaxially in the housing 4. A brushless DC motor is employed as the motor 33 in this embodiment; however, a brushed motor may alternatively be employed. An axial fan is employed as the fan 36. More specifically, the fan 36 includes a cup-shaped base part 361 and a plurality of blades 363 protruding from the base part 361. The base part 361 is disposed to cover the motor 33 from the rear and is coaxially fixed to an output shaft 331 of the motor 33. The fan 36 is rotated around the rotational axis A1 integrally with the output shaft 331, while the motor 33 is driven. Note that the structures of the fan 36 (such as the shape of the base part 361, the number of the blades 363, the arrangement of the fan 36 relative to the motor 33) may be changed as needed.

Figure 3:
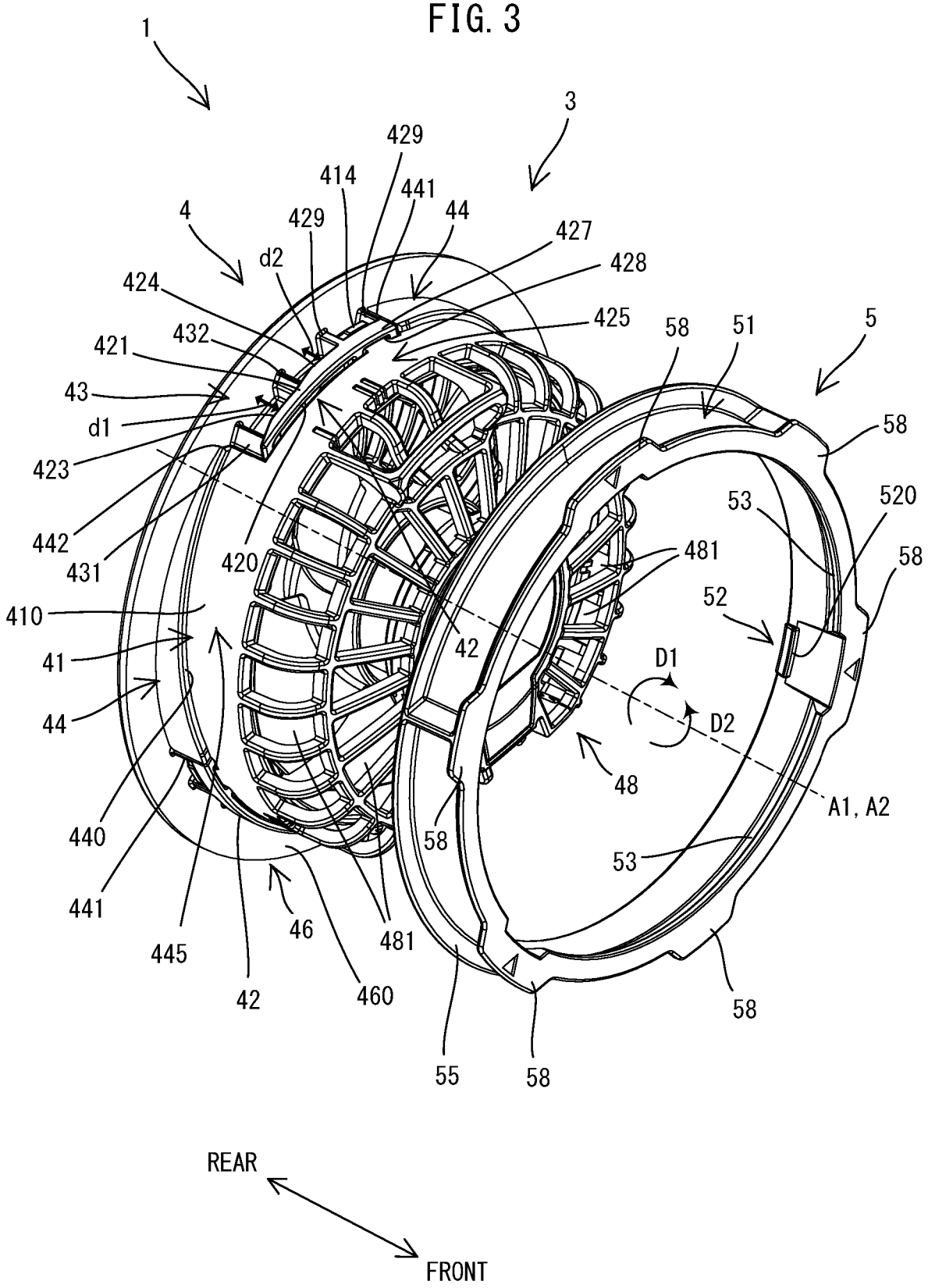
FIG. 3 is a perspective view of a fan unit 1, with a ring removed from a body.
Figure 4:
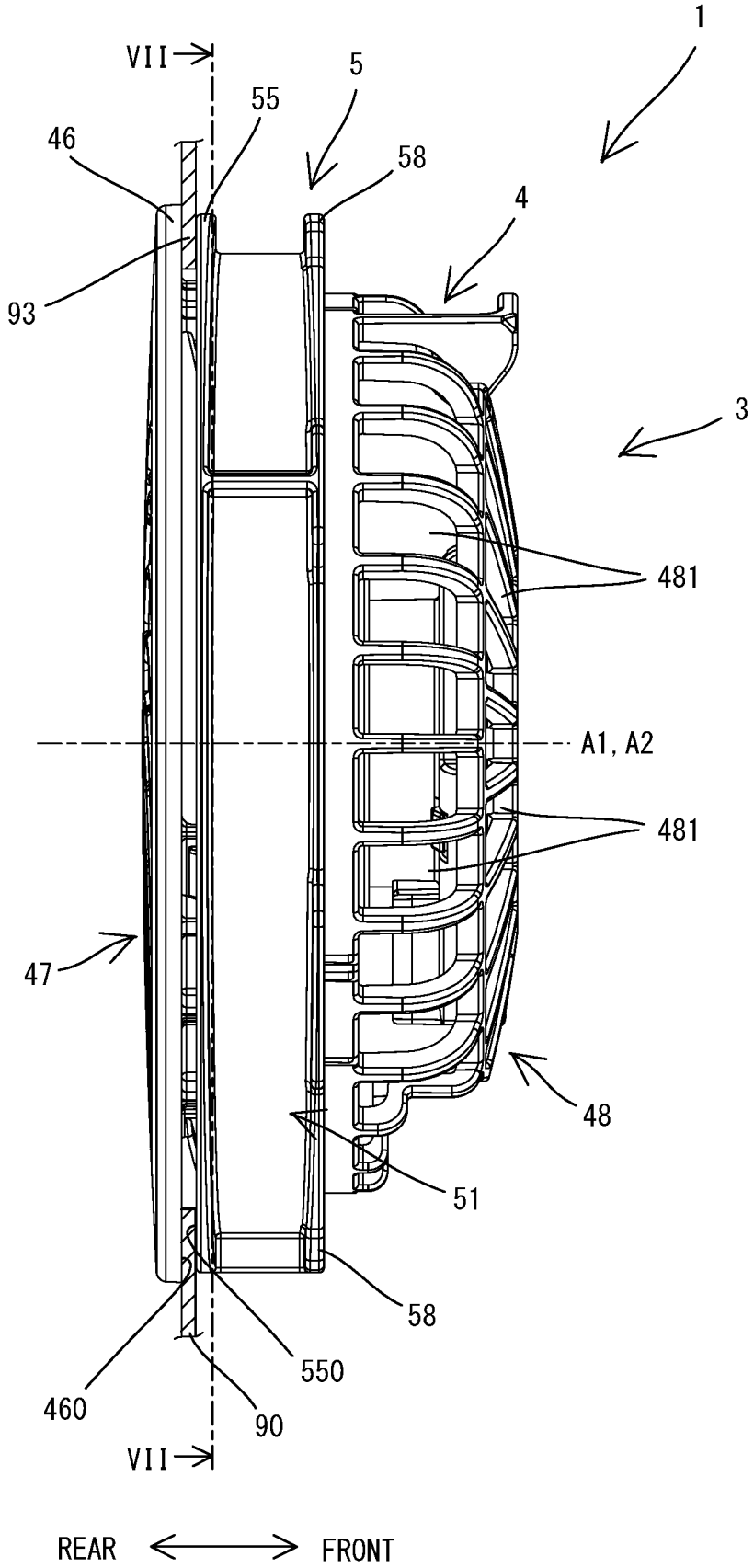
FIG. 4 is a side view of the fan unit.
Figure 5:
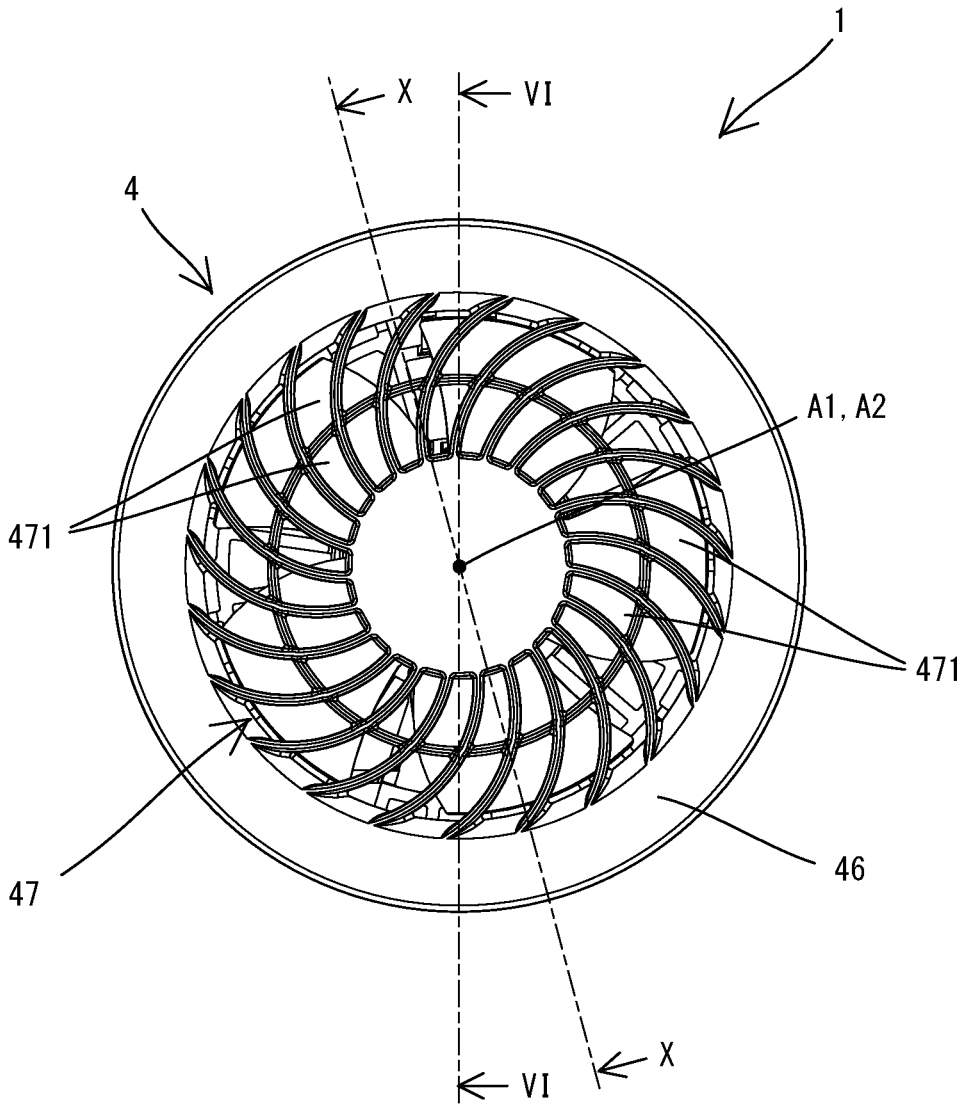
FIG. 5 is a rear view of the fan unit.
Figure 8:
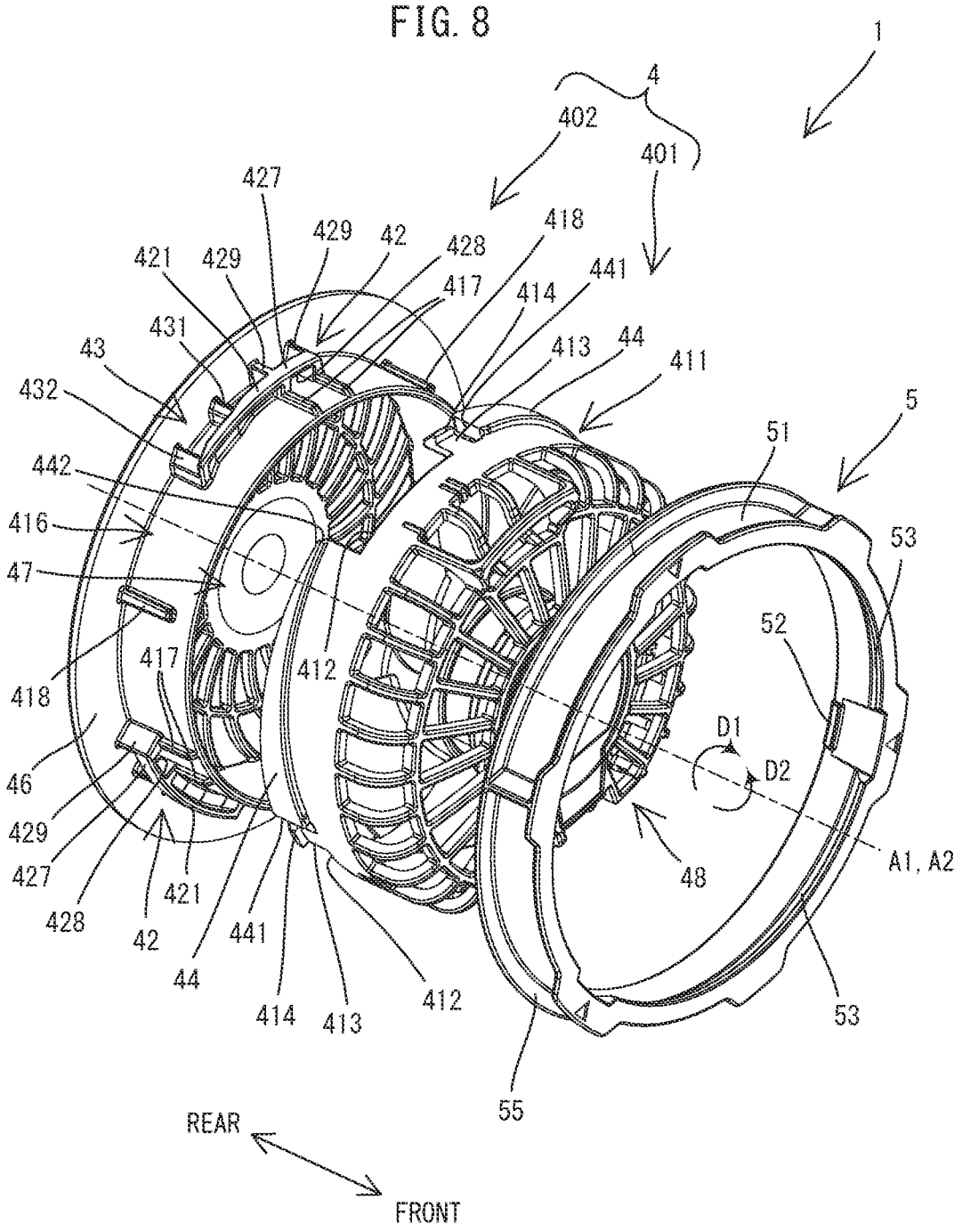
FIG. 8 is a perspective view of a front member, a rear member, and the ring each separated from one another.
Figure 9:
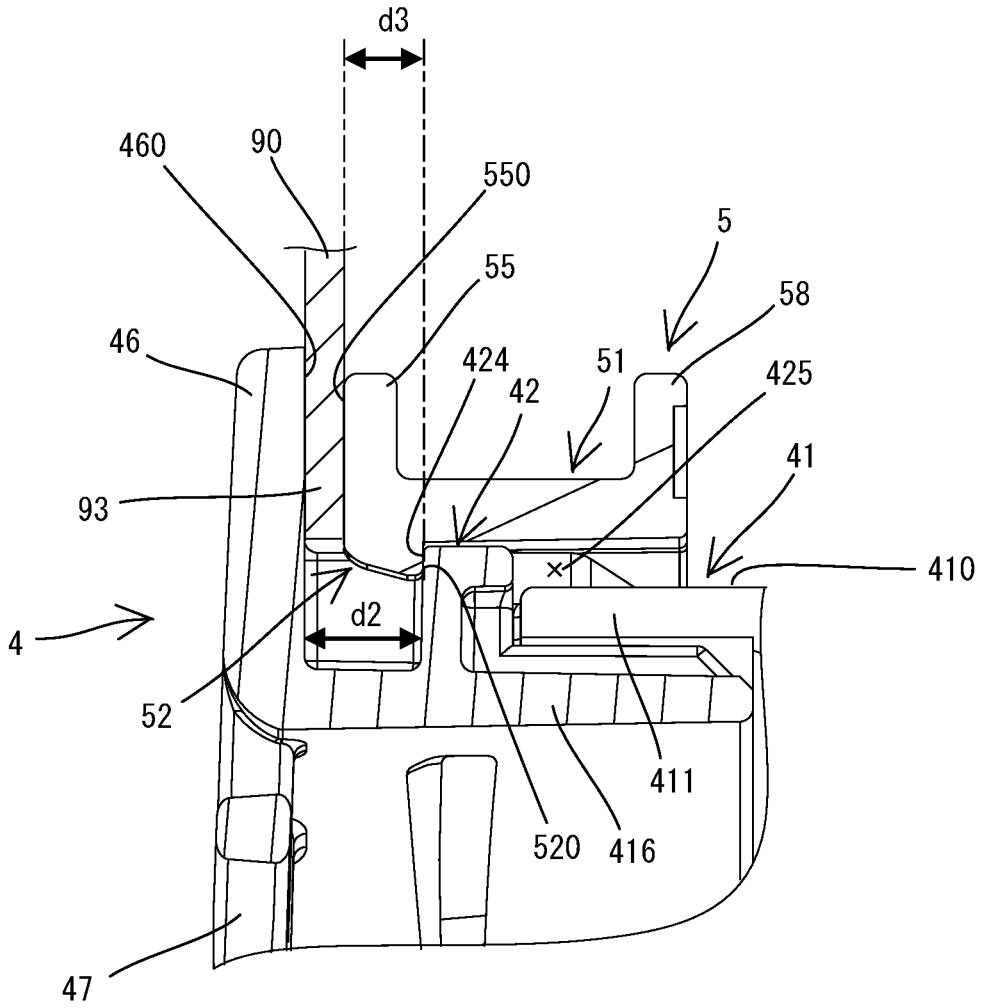
FIG. 9 is a partial, enlarged view of FIG. 6.

As shown in FIGS. 3 to 5, the housing 4, when viewed as a whole, includes the tubular part 41, the rear flange 46, an inlet-side cover 47, and a discharge-side cover 48. Furthermore, as shown in FIG. 6 and FIG. 8, the housing 4 is formed by a front member 401 and a rear member 402 in this embodiment. Each of the front member 401 and the rear member 402 is a single, integrally molded member formed of synthetic resin. The front member 401 includes an outer tubular part 411 of a hollow cylindrical shape, and the discharge-side cover 48 described above. The rear member 402 includes an inner tubular part 416 of a hollow cylindrical shape, and the rear flange 46 and the inlet-side cover 47 described above. The front member 401 and the rear member 402 are connected to each other by having the outer tubular part 411 of the front member 401 mounted (fitted) around the outer periphery of the inner tubular part 416 of the rear member 402. The inner tubular part 416 and the outer tubular part 411 together form the tubular part 41. Note that in this embodiment, the front member 401 and the rear member 402 are connected to each other in a separable manner, as will be described in detail later.

The tubular part 41 is a wall part of a hollow cylindrical shape (i.e. a peripheral wall part). As described above, since the tubular part 41 is formed by the inner tubular part 416 and the outer tubular part 411, a large part of the tubular part 41 has a double-walled structure. The outer peripheral surface 410 of the tubular part 41 is formed by the outer peripheral surface of the outer tubular part 411. The tubular part 41 is disposed at least partially around the fan 36 (surrounding the fan 36), coaxially with the rotational axis A1 of the fan 36. The outer diameter of the tubular part 41 is set smaller than the inner diameter of the tubular part 51 of the ring 5. That is, a distance between the rotational axis A1 of the fan 36 (the central axis of the tubular part 41) and the outer peripheral surface 410 of the tubular part 41 (specifically, of the outer tubular part 411) is smaller than a distance between the central axis A2 and the inner peripheral surface 510 of the tubular part 51 of the ring 5. Therefore, when the ring 5 is mounted (fitted) around the housing 4, the outer peripheral surface 410 of the tubular part 41 is spaced apart from the inner peripheral surface 510 of the ring 5 (see FIG. 7).

As shown in FIG. 3, the engagement walls 42, the rotation-restriction parts 43, and guide walls 44 are provided on the outer peripheral portion of the tubular part 41. Details of the engagement walls 42, the rotation-restriction parts 43, and the guide walls 44 will be described later.

As shown in FIG. 3 and FIG. 6, the rear flange 46 is a portion that is opposed to the front flange 55 of the ring 5 in the front-rear direction, and functions to clamp the fan attachment portion 93 (fabric 90) in conjunction with the front flange 55. The rear flange 46 protrudes radially outward of the tubular part 41 from an end portion thereof in the rotational-axis-A1 direction (the front-rear direction) on a suction side of the fan 36 (that is, a rear end portion of the tubular part 41). In this embodiment, the rear flange 46 is formed into a circular ring. Note that in this embodiment, the outer diameter of the rear flange 46 is set slightly larger than that of the front flange 55 of the ring 5. The rear flange 46 has a front surface 460 that extends in the direction approximately orthogonal to the rotational axis A1.

As shown in FIG. 5 and FIG. 6, the inlet-side cover 47 is configured as a circular cover that covers an opening at the rear end of the tubular part 41 (that is, an opening on the suction side of the fan 36). Multiple inlet openings 471 are formed in the inlet-side cover 47. As the fan 36 is rotated, air is sucked through the inlet openings 471 into the housing 4.

As shown in FIG. 3 and FIG. 6, the discharge-side cover 48 is disposed to cover an opening at a front end of the tubular part 41 (that is, an opening on a discharge side of the fan 46). In this embodiment, the discharge-side cover 48, as a whole, has a circular dome shape that protrudes frontward from the front end of the tubular part 41. Multiple discharge openings 481 are formed in the discharge-side cover 48. As the fan 36 is rotated, the air sucked through the inlet openings 471 into the housing 4 is discharged from the fan 46 through the discharge openings 481. A recess 489 is formed across a segment of the discharge-side cover 48 in the circumferential direction. A connector 37 is disposed between the recess 489 and the rotational axis A1. The connector 37 is electrically connected to the motor 33. A connector 973 (see FIG. 2) of the connecting cable 97, which is connected to the battery holder 95, can be placed in the recess 489 and connected to the connector 37. This makes electrical connection between the battery holder 95 and the fan unit 1.

The engagement walls 42, the rotation-restriction parts 43, and the guide walls 44, all of which are provided on the outer peripheral portion of the tubular part 41, are now described in this order.

First, the engagement walls 42 are described. As shown in FIGS. 3, 6, 7, 9, and 10, each of the engagement walls 42 is a wall part (protruding part) that protrudes radially outward of the outer peripheral surface of the tubular part 41 (or more specifically, of the outer tubular part 411). Thus, the engagement wall 42 is a wall part that has a thickness in the radial direction of the tubular part 41. The engagement wall 42 is spaced apart from the rear flange 46 in the rotational-axis-A1 direction (i.e., in the front-rear direction) of the tubular part 41 and extends in the circumferential direction of the tubular part 41. When viewed from the side of (or from a position radially outward of) the tubular part 41, the engagement wall 42 is narrow in the front-rear direction and elongate in the circumferential direction. A front end of the engagement wall 42 is located around midway through the tubular part 41 in the front-rear direction. In this embodiment, three such engagement walls 42 are disposed on the tubular part 41 at approximately equal intervals in the circumferential direction.

A distance between the rotational axis A1 of the fan 36 (the central axis of the tubular part 41) and an outer peripheral surface of the engagement wall 42 is approximately equal to or slightly smaller than the distance between the central axis A2 of the tubular part 51 and the inner peripheral surface 510 of the ring 5. Therefore, when the ring 5 is mounted (fitted) around the body 3, the outer peripheral surface of the engagement wall 42 at least partially makes substantial contact with the inner peripheral surface 510 of the ring 5.

Moreover, in front of a front surface 420 of each engagement wall 42, an open space 425 extends from the front surface 420 to the front end of the tubular part 41. The open space 425 has a shape that conforms to a segment (portion) of a hollow cylinder in its circumferential direction. More specifically, a radially outward end of the open space 425 is defined by a virtual curved surface containing the outer peripheral surface of the engagement wall 42, and a radially inward end of the open space 425 is defined by the outer peripheral surface 410 of the tubular part 41. Further, the open space 425 extends circumferentially from one end to the other end of the engagement wall 42 in the circumferential direction. Thus, in this embodiment, there is nothing particular protruding from the outer peripheral surface 410 of the tubular part 41 in front of the engagement wall 42. In other words, in an area that extends in front of the engagement wall 42 and that corresponds to the engagement wall 42 in the circumferential direction (ranges from one end to the other end of the engagement wall 42 in the circumferential direction), the outer peripheral surface 410 of the tubular part 41 forms a smooth surface (curved surface) with no projections.

In this embodiment, the engagement wall 42 includes a ring engagement part 421 and a hook engagement part 427. The hook engagement part 427 is an end portion of the engagement wall 42 that faces the first direction D1 (i.e. an end portion of the engagement wall 42 that is located on the first direction D1 side). The ring engagement part 421 is the remaining portion of the engagement wall 42 other than the hook engagement part 427, and occupies generally two thirds of the engagement wall 42 from an end that faces the second direction D2 (i.e. an end of the engagement wall 42 that is located on the second direction D2 side).

The ring engagement part 421 is configured to abut on the projection 52 of the ring 5 and thereby block (prevent) the ring 5 from moving away from the body 3 (the housing 4) in the rotational-axis-A1 direction (in other words, in a direction that the front flange 55 and the rear flange 46 move away from each other). Thus, the ring engagement part 421 is configured to block the ring 5 from moving frontward relative to the housing 4.

More specifically, a rear surface of the ring engagement part 421 (that is, a surface that is opposed to the rear flange 46) includes two engagement surfaces 423, 424. The engagement surfaces 423, 424 are located differently from each other in both the front-rear direction and the circumferential direction. Hereinafter, among the two engagement surfaces 423, 424, the engagement surface that is located more frontward (that is, farther from the rear flange 46) is referred to as the front engagement surface 423; whereas the engagement surface that is located more rearward (that is, closer to the rear flange 46) is referred to as the rear engagement surface 424. The rear engagement surface 424 is located on a side of the front engagement surface 423 that faces the first direction D1 (i.e. located on the first direction D1 side of the front engagement surface 423).

Each of the front engagement surface 423 and the rear engagement surface 424 is a flat surface that extends in a direction approximately orthogonal to the rotational axis A1. Each of the front engagement surface 423 and the rear engagement surface 424 is configured to make plane contact (or to make contact via multiple points or lines) with the front surface 520 (flat surface) of the projection 52 with stability. In this embodiment, the front engagement surface 423 and the rear engagement surface 424 are connected in the circumferential direction by an inclined (oblique) surface that is inclined (slopes) gradually as it extends circumferentially. Note that, however, the front engagement surface 423 and the rear engagement surface 424 may alternatively be connected by a surface that is approximately orthogonal to the front engagement surface 423 and the rear engagement surface 424.

Owing to the above-described configuration, a distance d1 between the front engagement surface 423 and the front surface 460 of the rear flange 46 in the front-rear direction is larger than a distance d2 between the rear engagement surface 424 and the front surface 460 of the rear flange 46 in the front-rear direction (see FIG. 3). Also, both the distance d1 and the distance d2 are set larger than a distance d3 between the front surface 520 of the projection 52 and the rear surface 550 of the front flange 55 of the ring 5 in the front-rear direction (see FIG. 9). Therefore, when the front surface 520 of the projection 52 is in contact with the front engagement surface 423 and also when the front surface 520 of the projection 52 is in contact with the rear engagement surface 424, the projection 52 is spaced apart frontward from the rear flange 46. In other words, a gap is formed (defined) between the rear surface 550 of the front flange 55 of the ring 5 and the front surface 460 of the rear flange 46 of the housing 4. The fabric 90 is placed in this gap and clamped between the front flange 55 and the rear flange 46.

The hook engagement part 427 is a portion of a mechanism for connecting the front member 401 and the rear member 402. The hook engagement part 427 is configured to engage with a hook (claw, projection, catch) 414 of an engagement piece (cantilever) 413 which will be described later. A rear surface of the hook engagement part 427 is a flat surface that extends in a direction approximately orthogonal to the rotational axis A1. An insertion hole 428 penetrates through the hook engagement part 427 in the front-rear direction. The insertion hole 428 is configured to receive the engagement piece 413 inserted therethrough.

Two partition walls 429 are provided rearward of the hook engagement part 427. Each partition wall 429 is configured as a wall part (protruded piece) that protrudes radially outward of the outer peripheral surface 410 of the tubular part 41 (more specifically, of the outer tubular part 411). The two partition walls 429 are located on both sides of the insertion hole 428 of the hook engagement part 427 in the circumferential direction of the tubular part 41, and extend in the front-rear direction so as to connect a rear surface of the engagement wall 42 and the front surface 460 of the rear flange 46. Note that a distance between the rotational axis A1 of the fan 36 (the central axis of the tubular part 41) and a tip end (protruded end) of each partition wall 429 is generally equal to or slightly smaller than the distance between the central axis A2 of the tubular part 51 and the inner peripheral surface 510 of the ring 5. Therefore, when the ring 5 is mounted around the body 3, the tip end of each partition wall 429 at least partially makes substantial contact with the inner peripheral surface 510 of the ring 5.

Next, the rotation-restriction parts 43 are described. each of the rotation-restriction part 43 is configured to abut on the projection 52 of the ring 5 and thereby restrict the ring 5 from moving (rotating) relative to the housing 4 in the circumferential direction around the rotational axis A1. More specifically, the rotation-restriction part 43 is configured to restrict the projection 52 placed at a position corresponding to the front engagement surface 423 (hereinafter referred to as a first engagement position) or at a position corresponding to the rear engagement surface 424 (hereinafter referred to as a second engagement position) from moving in a direction that causes the projection 52 to disengage from the engagement wall 42 (specifically, in the second direction D2).

Figure 7:
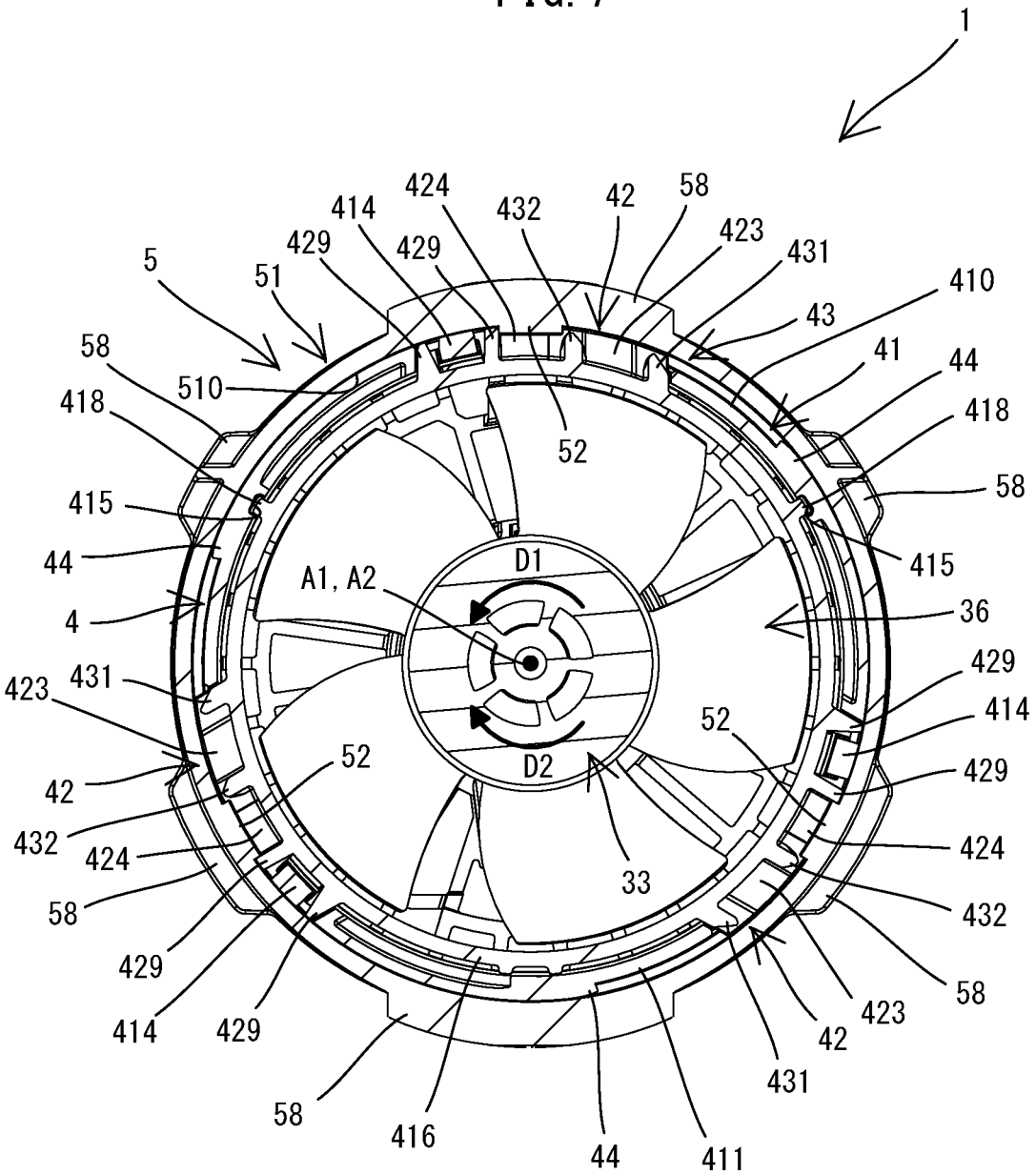
FIG. 7 is a cross-sectional view taken along line VII-VII of FIG. 4.

As shown in FIG. 3 and FIG. 7, the rotation-restriction part 43 includes two restriction walls 431, 432. Each of the restriction walls 431, 432 is configured as a wall part (protruded piece) that protrudes radially outward of the outer peripheral surface 410 of the tubular part 41 (more specifically, of the outer tubular part 411). Each of the restriction walls 431, 432 extends in the front-rear direction so as to connect the rear surface of the engagement wall 42 and the front surface 460 of the rear flange 46. The restriction wall 431 is located on a side of the front engagement surface 423 that faces the second direction D2 (i.e. located on the second direction D2 side of the front engagement surface 423). The restriction wall 432 is located on a side of the rear engagement surface 424 that faces the second direction D2 (i.e. located on the second direction D2 side of the rear engagement surface 424). Hereinafter, the restriction wall 431 that corresponds to the front engagement surface 423 is also referred to as the first restriction wall 431; whereas the restriction wall 432 that corresponds to the rear engagement surface 424 is also referred to as the second restriction wall 432. Also, in this embodiment, three rotation-restriction parts 43 (i.e., the three pairs of restriction walls 431, 432) are provided, respectively corresponding to the three engagement walls 42.

For each tip end portion (each radially outward end portion) of the restriction walls 431, 432, a surface that faces the second direction D2 (a second direction D2 side surface) is inclined (slopes) toward the first direction D1 as it extends radially outward. On the other hand, for each tip end portion of the restriction walls 431, 432, a surface that faces the first direction D1 (a first direction D1 side surface) is inclined (slopes) toward the second direction D2 as it extends radially outward. Assuming a circle of a radius extending from the rotational axis A1 to the tip end of the restriction wall 431 in a cross-section orthogonal to the rotational axis A1, an angle between a tangent line at the tip end of the restriction wall 431 and the first direction D1 side surface of the wall is larger than an angle between the same tangent line and the second direction D2 side surface of the wall. The same is true for the two surfaces of the restriction wall 432. The angles make it more difficult for the projection 52 to ride over the restriction walls 431, 432 when the ring 5 is rotated relative to the housing 4 in the second direction D2, than when the ring 5 is rotated relative to the housing 4 in the first direction D1.

Further, a distance between the rotational axis A1 of the fan 36 (the central axis of the tubular part 41) and the tip end (protruded end) of each restriction walls 431, 432 is smaller than the distance between the central axis A2 of the tubular part 51 and the inner peripheral surface 510 of the ring 5. Therefore, when the ring 5 is mounted around the body 3, the tip end of each restriction walls 431, 432 is located radially inward and spaced apart from the inner peripheral surface 510 of the tubular part 51 of the ring 5. Thus, neither tip of the restriction walls 431, 432 contacts the inner peripheral surface 510 of the ring 5. A distance between the tip end of each of the restriction walls 431, 432 and the inner peripheral surface 510 in the radial direction at this time is set slightly smaller than the length that the projection 52 protrudes from the inner peripheral surface 510 of the ring 5.

The guide walls 44 are described below. Each of the guide walls 44 is configured such that the guide wall 44 abuts on the projection 52 and thereby guide the projection 52 to a position where the projection 52 can engage the engagement wall 42 (the first engagement position) in the process of mounting the ring 5 on (around) the body 3.

Specifically, as shown in FIGS. 3, 6, and 7, each of the guide walls 44 is configured as a wall part (protruding or stepped part) that protrudes radially outward of the outer peripheral surface 410 of the tubular part 41 (more specifically, of the outer tubular part 411). That is, the guide wall 44 has a thickness in the radial direction of the tubular part 41. The guide wall 44 extends in the circumferential direction between two neighboring engagement walls 42. In this embodiment, three guide walls 44 are located at approximately equal intervals in the circumferential direction. An end of each guide wall 44 that faces the second direction D2 (a second direction D2 side end of the guide wall 44) is located at a substantially same position in the circumferential direction as an end of one engagement wall 42 that faces the first direction D1 (a first direction D1 side end of the engagement wall 42). This end of the guide wall 44 is hereinafter referred to as a first end 441. Another end of each guide wall 44 that faces the first direction D1 (a first direction D1 side end of the guide wall 44) is located at a substantially same position in the circumferential direction as an end of another engagement wall 42 that faces the second direction D2 (a second direction D2 side end of the engagement wall 42). This end of the guide wall 44 is hereinafter referred to as a second end 442. In this manner, in this embodiment, three engagement walls 42 and three guide walls 44 are arranged alternatingly in the circumferential direction, substantially with no gap therebetween.

In this embodiment, the guide wall 44 has an approximately right triangular shape as viewed from the side of the tubular part 41. More specifically, the first end 441 of the guide wall 44 extends linearly in the front-rear direction, and substantially contacts the first direction D1 side end of the engagement wall 42. A rear end of the guide wall 44 connects to the front surface 460 of the rear flange 46. A front surface 440 of the guide wall 44 is gradually inclined (slopes) rearward (in a direction toward the rear flange 46) at a substantially constant angle as it extends from the first end 441 to the second end 442 of the guide wall 44 (as it extends in the first direction D1). The front surface 440 of the guide wall 44 functions as a guide surface that abuts on the projection 52 and guides the projection 52.

At the first end 441, the front surface 440 of the guide wall 44 is at an approximately same position as the front surface 420 of the engagement wall 42 in the front-rear direction. That is, the front surface 440 substantially connects to (is substantially continuous with) the front surface 420 of the engagement wall 42. Also, at the second end 442 of the guide wall 44, the front surface 440 is at a position that is slightly spaced apart frontward from the front surface 460 of the rear flange 46 in the front-rear direction. More specifically, a distance in the front-rear direction between the front surface 440 of the guide wall 44 and the front surface 460 of the rear flange 46 at the second end 442 is approximately equal to a distance in the front-rear direction between the rear surface 550 of the front flange 55 and front surface 460 of the rear flange 46 when the projection 52 is engaged with (abuts on) the front engagement surface 423 (when the front surface 520 is in contact with the front engagement surface 423) (that is, the thickness of the fabric 90 to be clamped). Thus, the position of the front surface 440 at the second end 442 in the front-rear direction is set according to the thickness of the fabric 90 to be clamped by the front flange 55 and the rear flange 46.

A length that the guide wall 44 protrudes from the outer peripheral surface 410 of the tubular part 41 is approximately equal to a length that the engagement wall 42 protrudes from the outer peripheral surface 410. That is, a distance between the rotational axis A1 of the fan 36 (the central axis of the tubular part 41) and the outer peripheral surface of the guide wall 44 is generally equal to or slightly smaller than the distance between the central axis A2 of the tubular part 51 and the inner peripheral surface 510 of the ring 5. Therefore, when the ring 5 is mounted on the body 3, the outer peripheral surface of the guide wall 44 at least partially makes substantial contact with the inner peripheral surface 510 of the ring 5.

Furthermore, in front of each front surface 440 of the guide wall 44, an open space 445 extends from the front surface 440 to the front end of the tubular part 41. The open space 445 has a shape that generally conforms to a segment (portion) of a hollow cylinder. More specifically, a radially outward end of the open space 445 is defined by a virtual curved surface containing the outer peripheral surface of the guide wall 44 and a radially inward end of the open space 445 is defined by the outer peripheral surface 410 of the tubular part 41. Further, the open space 445 extends circumferentially from the first end 441 to the second end 442 of the guide wall 44. Thus, in this embodiment, there is nothing particular protruding from the outer peripheral surface 410 of the tubular part 41 in front of the guide wall 44. In other words, in an area that extends in front of the guide wall 44 and that corresponds to the guide wall 44 in the circumferential direction (ranges from the first end 441 to the second end 442 in the circumferential direction), the outer peripheral surface 410 of the tubular part 41 forms a smooth surface (curved surface) with no projections.

The following describes the action of the fan unit 1 in the process of being attached and removed to and from a garment (the jacket 9, for example).

When attaching (mounting) the fan unit 1 to (on) the jacket 9, the user first inserts a portion of the body 3, with no ring 5 attached thereto, into the attachment hole 91 of the jacket 9 (see FIG. 2). Specifically, the tubular part 41 and the discharge-side cover 48 are inserted inside the jacket 9 through the attachment hole 91 while the rear flange 46 is held outside the back-body portion (the fan attachment portion 93). This results in the fan attachment portion 93 (the fabric 90) being located in front of the rear flange 46.

Thereafter, the user places the tubular part 51 of the ring 5 around the tubular part 41 of the housing 4 from inside the jacket 9. As described above, the open space 425 and the open space 445 respectively exist in front of each of the engagement wall 42 and each of the guide wall 44, and either space has nothing particular protruding from the outer peripheral surface 410 of the tubular part 41. Therefore, in the early phase of mounting the tubular part 51 around the tubular part 41, the projections 52 of the ring 5 are slightly spaced apart from the outer peripheral surface 410 of the tubular part 41 and thus free to move with no interference.

Once the user has moved the ring 5 rearward relative to the housing 5 to some extent, the rear end portion of each of the projections 52 abuts on the front surface 420 of one of the engagement walls 42 or on the front surface 440 of one of the guide walls 44. Based on the recognition that the projections 52 have abutted on something, the user rotates the ring 5 in the first direction D1 while pushing the ring 5 rearward relative to the housing 4. In a case where the projection 52 has abutted on the engagement wall 42, then the rear end portion of the projection 52 slides in the first direction D1 along the front surface 420 of the corresponding engagement wall 42 and the front surface 440 of the corresponding guide wall 44 until the projection 52 reaches the second end 442 of the corresponding guide wall 44. In a case where the projection 52 has abutted on one of the guide walls 44, then the rear end portion of the projection 52 slides in the first direction D1 along the front surface 440 of the corresponding guide wall 44 until the projection 52 reaches the second end 442 of the corresponding guide wall 44.

As the user rotates the ring 5 further in the first direction D1, each of the projections 52 rides over the first restriction wall 431 into a region behind one of the engagement walls 42 and reaches the first engagement position. Note that a slight elastic deformation of the tubular part 51 in the radial direction is sufficient to enable the projection 52 to ride over the first restriction wall 431, since the second direction D2 side surface of the first restriction wall 431 is inclined and the lengths of protrusion of the projection 52 and the first restriction wall 431 are respectively set as discussed above. In a case where the jacket 9 is made of a relatively thick fabric 90, the fan attachment portion 93 is clamped between the front flange 55 and the rear flange 46 once the projections 52 reach their respective first engagement positions. This completes the attachment of the ring 5 to the body 3 (housing 4) and in turn the attachment of the fan unit 1 to the jacket 9.

At the first engagement position, the projection 52 is engaged with the engagement wall 42 and held (retained) in the position in the rotational-axis-A1 direction (the front-rear direction) by the engagement wall 42. More specifically, when the projection 52 is at the first engagement position, the front surface 520 of the projection 52 abuts on the front engagement surface 423 of the engagement wall 42, and this blocks (prevents) the ring 5 from moving frontward relative to the housing 4 (that is, in a direction that the ring 5 moves away from (or comes off) the body 3 in the front-rear direction). As described above, the engagement wall 42 protrudes radially outward such that the engagement wall 42 substantially contacts the inner peripheral surface 510 of the tubular part 51 of the ring 5. Therefore, even if the ring 5 undergoes a slight elastic deformation in the radial direction, the projection 52 may not ride over and disengage from the engagement wall 42 frontward.

In a case where the fan attachment portion 93 has a sufficient thickness relative to the distance between the front flange 55 and the rear flange 46, then the front surface 520 of each of the projections 52 is pressed against the front engagement surface 423 by an elastic force from the fan attachment portion 93 (the fabric 90) clamped between the front flange 55 and the rear flange 46. This allows the ring 5 to be stably attached to the housing 4.

At the first engagement position, the projection 52 is also held (retained) in the position in the circumferential direction by the first restriction wall 431 and the second restriction wall 432. More specifically, when the ring 5 is rotated relative to the housing 4 in the second direction D2 (that is, in a direction that causes the projection 52 to come off the engagement wall 42 in the circumferential direction), the tip end portion of the first restriction wall 431 abuts on the tip end portion of the projection 52 and thereby restricts rotation of the ring 5. This reduces the possibility of the ring 5 coming off the housing 4. Furthermore, when the ring 5 is rotated relative to the housing 4 in the first direction D1, the tip end portion of the second restriction wall 432 abuts on the tip end portion of the projection 52 and thereby restricts the ring 5 from rotating. Note that the term "restrict" used herein means that some rotation would be allowed if the ring 5 undergoes an elastic deformation in the radial direction in response to an external force, rather than that the ring 5 would be completely prohibited from rotating relative to the body 3. As described above, the angle of inclination of the first direction D1 side surface of the first restriction wall 431 is set such that the first restriction wall 431 would be difficult for the projection 52 to ride over in the second direction D2.

On the other hand, in a case where the jacket 9 is made of a relatively thin fabric 90, the user rotates the ring 5 further in the first direction D1. Each of the projections 52 then rides over the second restriction part 432, moving from the first engagement position to the second engagement position. Note that similarly to when riding over the first restriction wall 431, a slight elastic deformation of the tubular part 51 in the radial direction enables the projection 52 to ride over the second restriction wall 432. Once the projections 52 have reached their respective second engagement positions, the fan attachment portion 93 is clamped between the front flange 55 and the rear flange 46. This completes the attachment of the ring 5 to the body 3, that is, the attachment of the fan unit 1 to the jacket 9.

When the projection 52 is at the second engagement position, the front surface 520 of the projection 52 abuts on the rear engagement surface 424 of the engagement wall 42. This blocks (prevents) the ring 5 from moving frontward relative to the housing 4.

At the second engagement position, the projection 52 is also held (retained) in the position in the circumferential direction by the second restriction wall 432 and the partition wall 429. More specifically, when the ring 5 is rotated relative to the housing 4 in the second direction D2 (that is, in a direction that causes the projection 52 to come off the engagement wall 42 in the circumferential direction), the tip end portion of the second restriction wall 432 abuts on the tip end portion of the projection 52 and thereby restricts rotation of the ring 5. When the ring 5 is rotated relative to the housing 4 in the first direction D1, the tip end portion of the partition wall 429 abuts on the tip end portion of the projection 52 and thereby blocks (prevents) the ring 5 from rotating. As described above, the partition wall 429 protrudes radially outward such that the partition wall 429 substantially contacts the inner peripheral surface 510 of the tubular part 51 of the ring 5. Therefore, even if the ring 5 undergoes a slight elastic deformation in the radial direction, the projection 52 does not move in the first direction D1 over the partition wall 429.

In order to remove the fan unit 1 from the jacket 9, the user rotates the ring 5 relative to the housing 4 in the second direction D2. Each of the projections 52 positioned at the first engagement position (or at the second engagement position) rides over the first restriction wall 431 (or the second restriction wall 432 and the first restriction wall 431) as the ring 5 undergoes a slight elastic deformation, and leaves (disengages from) the engagement wall 42 at its second direction D2 side end. Thereafter, the user 5 moves the ring 5 frontward relative to the housing 4 and removes (separates) the ring 5 from the body 3. As described above, the open space 425 or the open space 445 extends in front of each of the projections 52 at this time, and either space has no protrusion that could interfere with the projection 52. Therefore, no matter where the projections 52 are located in the circumferential direction, the user can easily remove the ring 5 from the body 3 by moving the ring 5 frontward.

If the ring 5 and the housing 4 are engaged through an engagement between external threads and internal threads, as in a known example, the ring 5 needs to be rotated in one direction all the way until the projection 52 reaches a predefined position in the front-rear direction. If the ring 5 and the housing 4 are engaged through an engagement between a projection and a groove that has a specific opening for receiving the projection, as in another known example, the attachment of the ring 5 to the housing 4 requires positioning of the ring 5 and the housing 4 in a predefined direction in the circumferential direction.

On the other hand, for the fan unit 1 of this embodiment, the process of attaching the ring 5 to the housing 4 proceeds differently. Specifically, the front surface 440 (guide surface) of one of the guide walls 44 abuts on the projection 52 from the rear so as to guide the ring 5 rearward relative to the housing 4 and also to guide the projection 52 to the engagement position. Furthermore, the open space 445 extends from the front surface 440 in the direction toward which the projection 52 moves away from the front surface 440 in the front-rear direction (in a direction toward which the ring 5 moves away from the housing 5 or on a side of the front surface 40 where the ring 5 is received). Specifically, in front of the front surface 440, the open space 445 extends from the front surface 440 to the front end of the tubular part 41. This eliminates the need for the user to position the ring 5 relative to the housing 4 precisely at a specific position in the circumferential direction.

Instead, the user only needs to move the ring 5 rearward until the projections 53 respectively abut on the front surface 440 of the guide walls 44, followed by rotating the ring 5 in the first direction D1 such that the projections 52 slide on the front surfaces 440 of the guide walls 44, respectively. This swiftly brings the ring 5 to the engagement position.

In particular, in this embodiment, three engagement walls 42 and three guide walls 44 are arranged alternatingly at equal intervals in the circumferential direction. The front surface 440 of each guide wall 44 extends in the first direction D1 substantially continuously (continuatively) from the front surface 420 of one engagement wall 42, among the three engagement walls 42, that is located on the second direction D2 side of the guide wall 44 (that is, one of the engagement walls 42 located adjacent to the first end 441 of the guide wall 44). Therefore, the front surface 420 and the front surface 440 that are substantially continuous in the first direction D1 can function as, as a whole, one continuous guide surface for a next engagement wall 42 that is located on the first direction D1 side of the guide wall 44. Such three continuous guide surfaces (that is, three pairs of the front surface 420 and the front surface 440, each in continuation) can reliably guide the three projections 52 to their respective engagement positions. Furthermore, the three guide surfaces are arranged with no substantial gaps therebetween in the circumferential direction. This arrangement can completely eliminate the need for positioning the ring 5 in the circumferential direction, and therefore facilitate attaching procedure.

Also, in this embodiment, the front surface 440 (guide surface) of the guide wall 44 is inclined rearward as it extends in the first direction D1. This allows the user to achieve the attachment through ergonomically natural operations of rotating the ring 5 relative to the housing 4 in the first direction D1 while moving the ring 5 rearward.

Also, in this embodiment, the two engagement surfaces 423, 424 are provided on the same engagement wall 42, as described above. This allows the user to engage the ring 5 (projection 52) with one of the engagement surfaces 423, 424 as suitable according to the thickness of the fabric 90 while rotating the ring 5 relative to the housing 4 in the first direction D1. Thus, this configuration can eliminate the need for the user to remove the ring 5 from the housing 4 and then attach it again, and therefore facilitate attaching procedure.

Further, in this embodiment, once the three projections 52 are brought to their respective engagement positions, the three projections 52 respectively abut on the engagement walls 42 at three positions in the circumferential direction. This configuration can reduce the possibility of the ring 5 disengaging from (coming off) the housing 4, more reliably than in a case where only one projection 52 is provided.

Further, in this embodiment, each of the projections 52 abuts on the restriction walls 431, 432 each provided on the second direction D2 side of the corresponding engagement position, and this restricts the ring 5 from rotating relative to the housing 4 in the second direction D2. Thus, in this embodiment, each of the projections 52 fulfills two functions of: (i) blocking (preventing) the ring 5 from moving in a direction away from the housing 4 in the front-rear direction; and (ii) restricting the ring 5 from rotating in a direction that causes the projection 52 to disengage from (come off) the corresponding engagement wall 42 in the circumferential direction. In this manner, the possibility of the ring 5 disengaging from the housing 4 can be reduced by a simpler structure compared with a case in which an additional structure is required for restricting rotation of the ring 5.

The structures for connecting the front member 401 and the rear member 402 are now described.

As shown in FIG. 6, the motor 33, the fan 36, and the connector 37 are all disposed inside the front member 401. When the front member 401 is not connected to the rear member 402, an opening at a rear end of the outer tubular part 411 is not closed. Thus, the fan 36 is visible through this opening. On the other hand, no parts (components) are disposed inside the rear member 402. In this embodiment, the rear member 402 also functions as a cover member that closes the opening on the rear end of the front member 401 after the parts such as the motor 33 and the fan 36 have been mounted therein.

In this embodiment, the outer tubular part 411 of the front member 401 is connected to the inner tubular part 416 of the rear member 402 such that the outer tubular part 411 partially covers the periphery of the inner tubular part 416. Therefore, as shown in FIGS. 6 to 8, the outer tubular part 411 and the inner tubular part 416 are provided with connecting structures described below.

In addition to the three engagement walls 42, the three rotation-restriction parts 43, and the three pairs of partition walls 429 described above, three pairs of (six) hook insertion guides 417 and two guide projections 418 are provided on the inner tubular part 416 of the rear member 402.

Each pair of (two) hook insertion guides 417 is provided for each hook engagement part 427 of each engagement wall 42. The two hook insertion guides 417 are located in front of the corresponding hook engagement part 427. Each of the two hook insertion guides 417 is an elongate projection provided on the outer peripheral surface of the inner tubular part 416, and extends, in pair, from each side of the insertion hole 428 of the hook engagement part 427 to a front end of the inner tubular part 416.

Each guide projection 418 is an elongate projection that is provided on the outer peripheral surface of the inner tubular part 416 and extends from the front surface of the rear flange 46 to a front end portion of the inner tubular part 416. The two guide projections 418 are spaced apart from each other in the circumferential direction.

Correspondingly, in addition to the three guide walls 44 described above, three recesses 412, three engagement pieces 413, and two guide grooves 415 are provided on the outer tubular part 411 of the front member 401.

Each recess 412 is recessed frontward from the rear end of the outer tubular part 411. The recesses 412 allow the engagement walls 42, the rotation-restriction parts 43, and the partition walls 429 provided on the inner tubular part 416 to project radially outward of the outer tubular part 411. Therefore, each recess 412 has an approximately rectangular shape when viewed from the side of (or from a position radially outward of) the outer tubular part 411 such that the recess 412 corresponds to an area where the engagement wall 42, the rotation-restriction part 43, and the pair of partition walls 429 are provided. Each recess 412 is formed in a range from the first end 441 of one guide wall 44 to the second end 442 of another neighboring guide wall 44 in the circumferential direction. A front end of each recess 412 is situated at where the front end of each engagement wall 42 is. Furthermore, a length of each recess 412 in the circumferential direction is generally equal to a length of each engagement wall 42 in the circumferential direction.

Each engagement piece (cantilever) 413 is formed into a strip (sheet) and extends rearward from the front end of each recess 412. The engagement piece 413 protrudes in an end portion of the recess 412 that faces the first direction D1 (an end portion of the recess 412 that is located on the first direction D1 side). The hook (claw, projection, catch) 414 is provided on a tip end portion (protruding end portion) of the engagement piece 413, and protrudes radially outward of the outer tubular part 411. The hook 414 has a front surface and a rear surface. The front surface extends in a direction approximately orthogonal to the rotational axis A1. The rear surface is inclined (slopes) radially inward of the outer tubular part 411 as it extends towards the tip end (rear end) of the engagement piece 413. The engagement piece 413 is elastically deformable (deflectable, flexible) at least in the radial direction of the outer tubular part 411.

Each guide groove 415 is an elongate groove formed on the inner peripheral surface of the outer tubular part 411. The guide groove 415 is engageable with the guide projection 418 on the inner tubular part 416. Two guide grooves 415 are formed at positions that respectively correspond to the two guide projections 418 on the inner tubular part 416 in the circumferential direction. Each projection 418 extends frontward from the rear end of the outer tubular part 411.

In order to connect the front member 401 to the rear member 402, an assembly worker or a user positions the front member 401 relative to the rear member 402 in the circumferential direction such that the three engagement pieces 413 are respectively situated in front of the three pairs of hook insertion guides 417. The worker/user then moves the hooks 414 rearward along the hook insertion guides 417. The guide projections 418 on the inner tubular part 416 proceed into the respective guide grooves 415 and thereby stably guide the movement of the front member 401 relative to the rear member 402 in the front-rear direction. Once the rear surface (inclined surface) of each hook 414 abuts on an upper end of the corresponding hook engagement part 427, the engagement piece 413 deflects radially inward and the hook 414 proceeds into the insertion hole 428. The engagement wall 42, the rotation-restriction part 43, and the pair of partition walls 429 then proceed into the recess 412. Once the hook 414 has passed through the insertion hole 428, the engagement piece 413 recovers its original position due to its resiliency. This allows the engagement piece 413 to be engaged with the hook engagement part 427 while the front surface of the hook 414 abuts on the rear surface of the hook engagement part 427. The rear end surface of the outer tubular part 411 is located at a generally same position as the front surface of the rear flange 46. The procedure described hereinabove achieves connection of the front member 401 and the rear member 402.

In order to separate the front member 401 from the rear member 402, the user may push the hook 414 radially inward from outside the tubular part 41 by using a tool with an elongate end (a screwdriver, for example). The user can thus deflect the engagement piece 413 and releases (disengages) the hook 414 from the hook engagement part 427. With all the hooks 414 released from engagement, the user can move the front member 401 frontward and away from the rear member 402. Prolonged use of the fan unit 1 may cause dustiness inside the housing 4 and on the fan 36. In such cases, the user can separate the front member 401 and the rear member 402 following the above-described procedure to clean the fan 36 and inside the housing 4.

Also, in this embodiment, since the engagement walls 42 are provided on the rear member 402 (specifically, on the inner tubular part 416) as described above, the ring 5 cannot be attached to the housing 4 unless the rear member 402 is connected to the front member 401. This configuration can prevent the fan unit 1 to be attached to and used with the jacket 9 before the complete assembling of the housing 4. In particular, since the motor 33 and the fan 36 are accommodated in the front member 401 in this embodiment, the fan 36 is accessible via the opening on the rear end of the front member 401 when the rear member 402 including the inlet-side cover 47 (that is, the fan guard) is not yet connected to the front member 401. Therefore, in this embodiment, the fan unit 1 can be prevented from being used without the inlet-side cover 47 in place.

Also, as described above, the ridges 53 are formed on the inner peripheral surface 510 of the ring 5 more frontward than the projections 52. Therefore, in the event that the front member 401 and the rear member 402 are disconnected due to some reasons while the projections 52 of the ring 5 are respectively engaged with the engagement walls 42 of the rear member 402, the ridges 53 of the ring 5 will abut on the guide walls 44 from the front to prevent the front member 401 from falling off through the ring 5.

Correspondences between the features of the above-described embodiment and the features of the present disclosure or invention are as follows. The features of the above-described embodiment are, however, merely exemplary and thus do not limit the features of the present disclosure.

The fan unit 1 is an example of the "ventilation apparatus". The motor 33 is an example of the "motor". The fan 36 is an example of the "fan". The rotational axis A1 is an example of the "first axis". The housing 4, the tubular part 41, and the rear flange 46 are examples of the "housing", the "peripheral wall part", and the "first clamping part", respectively. The ring 5 and the front flange 55 are examples of the "ring" and the "second clamping part", respectively. The projection 52 is an example of the "projection". The inner peripheral surface 510 of the ring 5 is an example of the "first surface". The outer peripheral surface 410 of the tubular part 41 is an example of the "second surface". The engagement wall 42 is an example of the "engagement wall". Each of the engagement surfaces 423, 424 is an example of the "engagement surface", respectively. The guide wall 44 is an example of the "guide wall". The front surface 440 is an example of the "guide surface". The open space 445 is an example of the "open space".

The projection 52 is an example of the "first rotation-restriction part". Each of the restriction walls 431, 432 is an example of the "second rotation-restriction part" and is also an example of the "restriction wall". The rear member 402 and the front member 401 are examples of the "first member" and the "second member", respectively. The inlet-side cover 47 and the inlet opening 471 are examples of the "inlet-side cover" and the "inlet opening", respectively. The discharge-side cover 48 and the discharge opening 481 are examples of the "discharge-side cover" and the "discharge opening", respectively. The ridge 53 is an example of the "additional projection". The inner tubular part 416 and the outer tubular part 411 are examples of the "first peripheral wall part" and the "second peripheral wall part", respectively. The recess 412 is an example of the "recess". The engagement piece 413 and the hook 414 are examples of the "engagement piece" and the "hook", respectively. The first end 441 and the second end 442 of the guide wall 44 are examples of the "first end" and the "second end", respectively. The first direction D1 is an example of "the first direction". The second direction D2 is an example of "the second direction".

Note that the above-described embodiment is merely an exemplary embodiment of the present disclosure, and ventilation apparatuses according to the present disclosure are not limited to the fan unit 1 of the above-described embodiment. For example, following modifications may be made. Note that one or more of these modifications may be employed in combination with the fan unit 1 of the above-described embodiment or any one of the claimed features.

For example, as long as the ring 5 is removably attachable to the housing 4, the structures (such as shapes, sizes, and components) of the housing 4 and the ring 5 may be changed appropriately.

For example, the structures of the inlet-side cover 47 and the discharge-side cover 48 of the housing 4 (such as the numbers and the arrangements of the inlet openings 471 and the discharge openings 481) may be changed. Furthermore, the structures for clamping the fan attachment portion 93 (fabric 90) are not limited to the rear flange 46 and the front flange 55 described above. For example, the rear flange 46 and the front flange 55 may each have a polygonal outer periphery rather than the circular outer periphery. Furthermore, at least one of the rear flange 46 and the front flange 55 may be notched at least partially on its circumference, or may have openings. Furthermore, instead of the front flange 55, a plurality of projections may be provided at a plurality of circumferential positions and protrude radially outward from the tubular part 51. Alternatively, in a case where the wall that forms the tubular part 51 has a radial thickness of a certain level, the fan attachment portion 93 (fabric 90) may be clamped between the rear flange 46 and the rear end of the tubular part 51. Similar modifications may be made as appropriate for the rear flange 46. Furthermore, the shape of the tabs 58 of the ring 5 may be changed appropriately or the tabs 58 may be omitted.

In the above-described embodiment, each of the guide walls 44 is configured to guide the ring 5 rearward in response to the ring 5 being rotated relative to the housing 4 in a clockwise direction as viewed from the front. However, the guide wall 44 may be configured the other way around. Specifically, the guide wall 44 may alternatively be configured to guide the ring 5 rearward in response to the ring 5 being rotated relative to the housing 4 in a counterclockwise direction as viewed from the front. Furthermore, inversely to the structures of the above-described embodiment, a projection/projections may be provided on the outer peripheral surface 410 of the tubular part 41 of the housing 4; whereas an engagement wall/engagement walls and a guide wall/guide walls may be correspondingly provided on the inner peripheral surface 510 of the ring 5. In this case, the guide wall of the ring 5 may have a rear surface (guide surface) that is inclined (slopes) frontward as it extends in a predetermined direction around the rotational axis A1 (central axis A2) and can abut on the projection of the housing 4 from the front. The engagement wall of the ring 5 may be provided adjacent to an end of the guide wall that faces a predetermined direction (located on the predetermined direction side) and may have an engagement surface that can abut on the projection of the housing 4 from the rear.

In the above-described embodiment, the second direction D2 side end of the engagement wall 42 is at an approximately same position as the first direction D1 side end (the second end 442) of the guide wall 44. However, as long as the projection 52 has a sufficient length in the circumferential direction and the front surface 440 of the guide wall 44 (the guide surface) is capable of guiding the projection 52 to the first engagement position, the second direction D2 side end of the engagement wall 42 may be slightly spaced apart from the second end 442 of the guide wall 44. Also, the second direction D2 side end of the engagement wall 42 may extend further in the second direction D2, past the second end 442 of the guide wall 44. In other words, the second direction D2 side end portion of the engagement wall 42 and the first direction D1 side end portion of the guide wall 44 may have a slight overlap in the circumferential direction. Specifically, the second direction D2 side end of the engagement wall 42 may be located more frontward than the first direction D1 side end of the guide wall 44, and the engagement surface 423 (and the engagement surface 424) may be opposed to the front surface 440 of the guide wall 44.

The shape and the number of the projections 52, and positions of the projections 52 on the ring 5 may be changed appropriately, as long as the projection(s) 52 can be engaged with (retained/held by) the engagement surfaces 423, 424. For example, the projection 52 may not necessarily be approximately rectangular-shaped. Note that, however, in order for the projection 52 to be stably held in place with respect to the engagement surfaces 423, 424, the contact of the projection 52 with the engagement surfaces 423, 424 may preferably be on multiple points or lines, or on a surface, rather than just on one point. Also, even though only one projection 52 is acceptable, it may be preferable that two or more projections 52 are provided in order to keep the ring 5 stably attached to the housing 4. Note that the numbers of the engagement walls 42 and the guide walls 44 may also be changed according to the number of the projections 52. The projection(s) 52 may not necessarily be located on the rear end portion of the ring 5 (tubular part 51), but may alternatively be located around midway in the front-end direction or on the front end portion. The distance between the engagement surfaces 423, 424 and the front surface 460 of the rear flange 46 on the housing 4 may be changed appropriately according to the distance between the front end of the projection 52 and the rear surface 550 of the front flange 55.

The number of the engagement surface, which engages with the projection 52, on the engagement wall 42 may be one. That is, the fan unit 1 may not necessarily be adaptable to fabrics 90 of different thicknesses. Alternatively, the number of the engagement surfaces may be three or more. If the number of the engagement surfaces (engagement positions) is changed, then the numbers of the restriction walls 431, 432 may also be changed accordingly.

Furthermore, in the above-described embodiment, the projection 52 has two functions of: (i) preventing the ring 5 from moving in a direction away from the housing 4; and (ii) restricting the ring 5 from rotating in a direction that causes the projection 52 to disengage from (come off) the engagement wall 42 in the circumferential direction. However, separately from the projection 52, an additional structure may be provided to restrict rotation of the ring 5 relative to the housing 4. For example, a recess may be provided on the outer peripheral surface 410 of the tubular part 41, and correspondingly, the ring 5 may have an elastically deformable engagement piece that has a hook engageable with the recess. Also, the rotation-restriction part 43 (the restriction walls 431, 432) may be omitted. The omission is possible because rotation of the ring 5 relative to the housing 4 can be restricted to some extent by the front surface 520 of the projection 52 being pressed against the engagement surface 423, 424 by the elastic force of the fabric 90.

In the above-described embodiment, the front surface 440 (guide surface) of the guide wall 44 is, as a whole, inclined at a substantially constant angle as it extends from the first end 441 to the second end 442. However, the structure of the front surface 440 may be changed appropriately, as long as it allows the ring 5 to move rearward relative to the housing 4 in response to the projection 52 moving in the first direction D1 while being abutted on the front surface 440. For example, the angle of inclination of the front surface 440 may vary between the first end 441 and the second end 442. As another example, the front surface 440 may partially be curved in the front-end direction. As a further example, the front surface 440 may be configured such that its position in the front-rear direction varies in a stepwise manner between the front end 441 and the second end 442. In other words, the front surface 440 may be formed into a step-like surface. Specifically, the front surface 440 may be formed by multiple flat surfaces that are approximately orthogonal to the rotational axis A1 (or multiple inclined surfaces inclined in the circumferential direction); and at least one connecting surface that connects two neighboring flat surfaces (or inclined surfaces). In this case, the closer the flat surface (or inclined surface) is to the second end 442, the more rearward it may be located compared to the flat surface (or inclined surface) closer to the first end 441.

Similar to the front surface 440 of the guide wall 44, the front surface 420 of the engagement wall 42 may also be inclined rearward as it extends in the first direction D1. In this case, the front surface 420 of the engagement wall 42, together with the front surface 440 of the guide wall 44 that substantially connects thereto on the first direction D1 side of the guide wall 44, form a continuous guide surface that is inclined rearward as it extends in the first direction D1. Note that even if the first end 441 of the guide wall 44 is slightly spaced apart from the engagement wall 42 that is located on the second direction D2 side of the guide wall 44, the front surface 420 of the engagement wall 42 and the front surface 440 of the guide wall 44 can form, as a whole, a substantially continuous guide surface, in a case where the projection 52 has a length in the circumferential direction that is sufficiently longer than the length of a gap between the engagement wall 42 and the guide wall 44 in the circumferential direction.

In the above-described embodiment, the front member 401 and the rear member 402 are separably connected to each other through an elastic engagement (snap-fit engagement) between the engagement piece 413 of the front member 401 and the engagement wall 42 of the rear member 402. However, separately from the engagement wall 42, an engagement part that is engageable with the engagement piece 413 may be provided on the rear member 402. Alternatively, the front member 401 and the rear member 402 may be separably connected to each other through a different mechanism. Further alternatively, the front member 401 and the rear member 402 may be connected to each other in a substantially inseparable manner.

The garment to which the fan unit 1 is removably attachable may not necessarily be an upper-body garment such as the jacket 9, but may also be, for example, a lower-body garment such as pants (trousers). Furthermore, in a case where the garment has a double-layered structure including an outer fabric and an inner fabric, the fan attachment portion 93 may be provided on the outer fabric and the discharge-side cover 48 may be disposed within an internal space formed (defined) between the outer fabric and the inner fabric when the fan unit 1 is attached. In this case, the outer fabric and the inner fabric may be left unsawn to define openings, as needed, in some areas such as cuffs and collar, so that air sent into the internal space can be discharged outside through the openings. Also, the position and the number of the fan attachment portion 93 on the garment may be changed appropriately.

Furthermore, in view of the nature of the present invention, the above-described embodiment and the modifications thereto, the following aspects are provided. At least one of the following aspects can be employed in combination with at least one of the above-described embodiment and modifications thereto, and the claimed features.

[Aspect 1]

Of the outer peripheral surface of the peripheral wall part of the housing, at least an area in front of the guide wall has no projection protruding radially outward from the outer peripheral surface.

[Aspect 2]

The distance from the first axis to the outer peripheral surface of the at least one engagement wall is approximately equal to the distance from the first axis to the outer peripheral surface of the at least one guide wall.

[Aspect 3]

The inner peripheral surface of the ring is at least partially substantially slidable with respect to the outer peripheral surface of the at least one engagement wall and the at least one guide wall.

[Aspect 4]

The distance from the first axis to the outer peripheral surface of the at least one restriction wall is smaller than the distance from the first axis to the outer peripheral surface of the at least one engagement wall.

[Aspect 5]

The plurality of engagement walls and the plurality of guide walls are arranged alternatingly in the circumferential direction, substantially with no gap therebetween.

[Aspect 6]

The at least one engagement wall is spaced apart frontward from the front surface of the first clamping part, and in the front-rear direction, the at least one engagement wall is located more rearward than the first end of the guide surface and more frontward than the second end of the guide surface.

[Aspect 7]

The plurality of engagement surfaces include a first engagement surface and a second engagement surface that is further in the first direction than the first engagement surface in the circumferential direction, and in the front-rear direction, the second engagement surface is located more rearward than the first engagement surface.

[Aspect 8]

The at least one engagement surface is configured to abut on the at least one projection from the rear or from the front to block the ring and the housing from moving away from each other in the front-rear direction.

[Aspect 9]

The at least one guide wall has a first end and a second end in the circumferential direction, the at least one engagement wall is located adjacent to the second end of the at least one guide wall in the circumferential direction, and the guide surface is configured such that its position in the front-rear direction varies as it extends from the first end to the second end.

[Aspect 10]

the guide surface is configured to guide the ring rearward relative to the housing, in the process of attaching the ring to the housing, by abutting on the at least one projection from a direction in the front-rear direction opposite to the at least one engagement surface and guiding the at least one projection in a first direction which is from the first end toward the second end, and also to guide the at least one projection to at least one engagement position at which the projection can abut on the at least one engagement surface.

DESCRIPTION OF THE REFERENCE NUMERALS

1: fan unit, 3: body, 33: motor, 331: output shaft, 36: fan, 361: base part, 363: blade, 37: connector, 4: housing, 401: front member, 402: rear member, 41: tubular part, 410: outer peripheral surface, 411: outer tubular part, 412: recess, 413: engagement piece, 414: hook, 415: guide groove, 416: inner tubular part, 417: hook insertion guide, 418: guide projection, 42: engagement wall, 420: front surface, 421: ring engagement part, 423: engagement surface (front engagement surface), 424: engagement surface (rear engagement surface), 425: open space, 427: hook engagement part, 428: insertion hole, 429: partition wall, 43: rotation-restriction part, 431: restriction wall (first restriction wall), 432: restriction wall (second restriction wall), 44: guide wall, 440: front surface, 441: first end, 442: second end, 445: open space, 46: flange (rear flange), 460: front surface, 47: inlet-side cover, 471: inlet opening, 48: discharge-side cover, 481: discharge opening, 489: recess, 5: ring, 51: tubular part, 510: inner peripheral surface, 52: projection, 520: front surface, 53: ridge, 55: flange (front flange), 550: rear surface, 58: tab, 9: jacket, 90: fabric, 91: attachment hole, 93: fan attachment portion, 94: pocket, 95: battery holder, 96: battery, 97: connecting cable, 973: connector, A1: rotational axis, A2: central axis, D1: first direction, D2: second direction.

What is claimed is:

1. A ventilation apparatus that is removably attachable to a garment, the ventilation apparatus comprising:

a motor;

a fan configured to be rotationally driven by the motor around a first axis, the first axis defining a front-rear direction of the ventilation apparatus;

a housing (i) accommodating the motor and the fan and (ii) including a peripheral wall part and a first clamping part, the peripheral wall part (i) having a hollow cylindrical shape and (ii) is around the fan, the first clamping part protruding radially outward from a rear end portion of the peripheral wall part; and a ring (i) having a hollow cylindrical shape, (ii) removably mounted around the peripheral wall part of the housing and (iii) having a second clamping part in front of the first clamping part of the housing and configured to clamp a fabric of the garment in conjunction with the first clamping part;

wherein:

at least one projection protrudes from a first surface in a radial direction of the peripheral wall part, the first surface being one of an outer peripheral surface of the peripheral wall part and an inner peripheral surface of the ring, at least one engagement wall and at least one guide wall each protrude from a second surface in the radial direction, the second surface being the other one of the outer peripheral surface of the peripheral wall part and the inner peripheral surface of the ring, the at least one engagement wall (i) is adjacent to one end of the at least one guide wall in a circumferential direction and (ii) has at least one engagement surface configured to block the ring from moving forward relative to the housing to prevent the first clamping part and the second clamping part from moving away from each other in the front-rear direction, the at least one guide wall has a guide surface configured to guide the ring rearward relative to the housing and to guide the at least one projection to at least one engagement position at which the projection is abuttable on the at least one engagement surface, the at least one engagement surface and the guide surface face opposite directions from each other in the front-rear direction, and in a direction in which the projection moves away from the guide surface in the front-rear direction, an open space extends from the guide surface to an area that corresponds to an end of the second surface.

2. The ventilation apparatus according to claim 1, wherein:

at least one first rotation-restriction part is on one of the housing and the ring, and at least one second rotation-restriction part is (i) on the other one of the housing and the ring and (ii) configured to engage with the first rotation-restriction part to restrict rotation of the ring relative to the housing around the first axis.

3. The ventilation apparatus according to claim 2, wherein:

the at least one first rotation-restriction part includes the at least one projection, the at least one second rotation-restriction part includes at least one restriction wall protruding from the second surface, and the at least one restriction wall is on a side of the at least one engagement position toward the at least one guide wall in the circumferential direction.

4. The ventilation apparatus according to claim 1, wherein:

when the at least one guide wall is on the outer peripheral surface of the peripheral wall part, the guide surface is a front surface of the at least one guide wall and is at least partially inclined rearward as the guide surface extends toward the one end in the circumferential direction, and when the at least one guide wall is on the inner peripheral surface of the ring, the guide surface is a rear surface of the at least one guide wall and is at least partially inclined frontward as the guide surface extends toward the one end in the circumferential direction.

5. The ventilation apparatus according to claim 1, wherein the at least one engagement surface includes a plurality of engagement surfaces that do not overlap each other in both the front-rear direction and the circumferential direction.

6. The ventilation apparatus according to claim 1, wherein:

the at least one projection includes a plurality of projections that are at equal intervals in the circumferential direction, the at least one guide wall includes a plurality of guide walls that are at equal intervals in the circumferential direction, the at least one engagement wall includes a plurality of engagement walls that are at equal intervals in the circumferential direction, and each of the plurality of guide walls extends in the circumferential direction between two neighboring engagement walls among the plurality of engagement walls.

7. The ventilation apparatus according to claim 1, wherein:

the at least one projection protrudes from the inner peripheral surface of the ring, and the at least one guide wall and the at least one engagement wall protrude from the outer peripheral surface of the peripheral wall part of the housing.

8. The ventilation apparatus according to claim 7, wherein:

the housing is formed by a first member and a second member separably connected to each other in the front-end direction, the first member at least includes the first clamping part and an inlet-side cover, the inlet-side cover having a plurality of inlet openings and covering an opening at a rear end of the peripheral wall part, the second member at least includes a portion of the peripheral wall part and a discharge-side cover, the discharge-side cover having a plurality of discharge openings and covering an opening at a front end of the peripheral wall part, and the first member includes the at least one engagement wall.

9. The ventilation apparatus according to claim 8, wherein:

the motor and the fan are accommodated in the second member.

10. The ventilation apparatus according to claim 8, wherein:

the second member includes the at least one guide wall; and the inner peripheral surface of the ring includes at least one additional projection that is frontward from the at least one projection and protrudes radially inward.

11. The ventilation apparatus according to claim 10, wherein:

the first member includes a first peripheral wall part that is a portion of the peripheral wall part, the second member includes a second peripheral wall part that is another portion of the peripheral wall part and is partially fitted around the first peripheral wall part, an outer peripheral surface of the second peripheral wall part forms the outer peripheral surface of the peripheral wall part, and the first peripheral wall part of the first member has the at least one engagement wall, the at least one engagement wall protruding radially outward from the outer peripheral surface through at least one recess formed in the second peripheral wall part.

12. The ventilation apparatus according to claim 8, wherein:

the first member includes a first peripheral wall part that is a portion of the peripheral wall part, the second member includes a second peripheral wall part that is another portion of the peripheral wall part and is partially fitted around the first peripheral wall part, an outer peripheral surface of the second peripheral wall part forms the outer peripheral surface of the peripheral wall part, and the first peripheral wall part of the first member has the at least one engagement wall, the at least one engagement wall protruding radially outward from the outer peripheral surface through at least one recess formed in the second peripheral wall part.

13. The ventilation apparatus according to claim 8, wherein:

the second member has at least one engagement piece, the at least one engagement piece having a hook on its tip end portion and being elastically deformable in the radial direction, and the hook is engaged with the at least one engagement wall such that the hook is disengageable in response to elastic deformation of the at least one engagement piece.

14. The ventilation apparatus according to claim 8, wherein:

the at least one projection includes a plurality of projections that are at equal intervals in the circumferential direction, the at least one guide wall includes a plurality of guide walls that are at equal intervals in the circumferential direction, the at least one engagement wall includes a plurality of engagement walls that are at equal intervals in the circumferential direction, each of the plurality of guide walls extends in the circumferential direction between two neighboring engagement walls among the plurality of engagement walls, and has a first end and a second end in the circumferential direction, the guide surface is a front surface of each of the plurality of guide walls, and is configured to guide the projection in a first direction from the first end toward the second end, and the guide surface extends in the first direction substantially continuously from a front surface of one of the plurality of engagement walls that is located on a second direction side of the guide wall, the second direction being opposite to the first direction.

15. The ventilation apparatus according to claim 7, wherein:

the at least one projection includes a plurality of projections that are at equal intervals in the circumferential direction, the at least one guide wall includes a plurality of guide walls that are at equal intervals in the circumferential direction, the at least one engagement wall includes a plurality of engagement walls that are at equal intervals in the circumferential direction, each of the plurality of guide walls extends in the circumferential direction between two neighboring engagement walls among the plurality of engagement walls, and has a first end and a second end in the circumferential direction, the guide surface is a front surface of each of the plurality of guide walls, and is configured to guide the projection in a first direction from the first end toward the second end, and the guide surface extends in the first direction substantially continuously from a front surface of one of the plurality of engagement walls that is located on a second direction side of the guide wall, the second direction being opposite to the first direction.

16. The ventilation apparatus according to claim 15, wherein each of the plurality of engagement walls has a first engagement surface and a second engagement surface that do not overlap in both the front-rear direction and the circumferential direction.

17. The ventilation apparatus according to claim 16, further comprising:

a plurality of first restriction walls protruding from the outer peripheral surface of the peripheral wall part of the housing; and a plurality of second restriction walls protruding from the outer peripheral surface of the peripheral wall part of the housing, wherein:

each of the plurality of first restriction walls is located on the second direction side of the first engagement surface, and each of the plurality of second restriction walls is located on the second direction side of the second engagement surface.

18. The ventilation apparatus according to claim 15, wherein:

the at least one guide wall has an approximately right triangular shape when the peripheral wall part is viewed from a position radially outward of the peripheral wall part, the first end substantially connects to an end of the one engagement wall, among the plurality of engagement walls, that is located on the second direction side of the guide wall, a rear end of the at least one guide wall substantially connects to a front surface of the first clamping part, and the guide surface is inclined rearward from the first end toward the second end at a substantially constant angle.

* * * * *